US007510002B2

(12) United States Patent
Brown et al.

(10) Patent No.: US 7,510,002 B2
(45) Date of Patent: Mar. 31, 2009

(54) APPARATUS AND METHOD FOR SEALING A WELLBORE

(75) Inventors: Gareth Edward George Brown, Aberdeen (GB); Frederick Duguld McKay, Aberdeen (GB); Colin Alexander Black, Inverurie (GB)

(73) Assignee: Hunting Cromar Limited, Aberdeen, Scotland (GB)

( * ) Notice: Subject to any disclaimer, the term of this patent is extended or adjusted under 35 U.S.C. 154(b) by 145 days.

(21) Appl. No.: 11/070,114

(22) Filed: Mar. 2, 2005

(65) Prior Publication Data

US 2006/0102359 A1 May 18, 2006

(51) Int. Cl.
*E21B 33/06* (2006.01)

(52) U.S. Cl. ..... 166/84.3; 166/330; 166/85.4; 251/1.1

(58) Field of Classification Search ..... 166/379, 166/84.3, 55.3, 330, 332.2, 85.4; 251/1.1
See application file for complete search history.

(56) References Cited

U.S. PATENT DOCUMENTS 1,228,686 A * 6/1917 Maxwell ..... 166/83.1
1,938,019 A * 12/1933 Hild ..... 175/25
2,313,177 A * 3/1943 Sprague ..... 251/59
2,504,377 A * 4/1950 Beil ..... 251/1.1
3,561,723 A * 2/1971 Cugini ..... 251/1.2
3,589,667 A 6/1971 Lewis
4,537,250 A * 8/1985 Troxell, Jr. ..... 166/55
4,938,290 A * 7/1990 Leggett et al. ..... 166/387
5,284,209 A 2/1994 Godfrey
5,575,336 A 11/1996 Morgan
5,662,171 A * 9/1997 Brugman et al. ..... 166/383
6,152,229 A 11/2000 Jennings
2002/0152856 A1 10/2002 Brumlet et al.
2004/0003920 A1 * 1/2004 Boyd ..... 166/85.4
2006/0254822 A1 * 11/2006 Ayling ..... 175/57

FOREIGN PATENT DOCUMENTS

WO WO 93/02273 2/1993

* cited by examiner

*Primary Examiner*—Kenneth Thompson
*Assistant Examiner*—David Andrews
(74) *Attorney, Agent, or Firm*—Jones Walker

(57) ABSTRACT

An improved valve for sealing a wellbore and method of use, in particular for prevention of well blow outs. In one embodiment, the apparatus is designed to seal a well through rotation of rams. The rams may be actuated to seal the well without having to work against full well pressure as fluid volumes in the apparatus housing, which also contains the rams, are preserved. This functionality allows the apparatus to be constructed with smaller dimensions than existing prior art blow out prevention valves aiding handling and manoeuvrability. The improved valve according to one embodiment also has a mechanism that guides a wireline or a pipeline being run in the wellbore to the centre of the bore and allows a seal to be formed around the wireline or pipeline.

33 Claims, 20 Drawing Sheets

APPARATUS AND METHOD FOR SEALING A WELLBORE

This application claims priority from United Kingdom (GB) Patent Application Number 0425117.9 filed on 13 Nov. 2004.

FIELD OF THE INVENTION

The present invention relates to valves, and in particular to an improved valve for use in wireline and wellhead control systems for the oil and gas industry. In one aspect the invention relates to an improved blow out preventer (BOP).

BACKGROUND OF THE INVENTION

Specialised valves, including blow out preventers (BOPs), have been available for many decades, and provide a means for sealing the wellbore at the wellhead against well pressure if the drilling crew loses control of formation of fluids or if required to seal a wireline or logging cable during well service operations. A conventional ram type BOP is located at the wellhead, and consists of two halves of a cover for the wellbore, located on diametrically opposed sides of the well bore. The covers consist of steel rams and elastomeric ram blocks, and are typically actuated by large diameter hydraulic cylinders located on each side of the wellbore. If a well control event occurs, the hydraulic cylinders will be remotely actuated to force the rams to enter the wellbore from either side, meeting at the centre to seal against well pressure below. Importantly, the BOP must have the ability to seal the wellbore without cutting the wireline, allowing subsequent retrieval of the toolstring.

The ram blocks will typically have cooperating, shaped surfaces to ensure alignment. The ram blocks are available in a variety of configurations, and for applications where pipeline or wireline is being run in the well will be provided with a cut-out formation (typically a corresponding pair of semi-circular recesses defining a narrow throughbore) designed to allow the wireline or pipeline to extend through the BOP without damage. The ram blocks will be designed such that a tight seal is formed around the pipeline or wireline and around the aperture through which the rams move. The ram blocks will often be provided with a guide, such that when the rams move from an open to a closed position, the pipeline or wireline is guided into the centre of the wellbore such that it is received in the cut-out formation without damage.

The rams in a typical ram BOP are self-energising, in the sense that after they are initially actuated by the hydraulics, well pressure is allowed to get behind a part of the ram, forcing it towards a closed position. The elastomeric seals of the ram blocks are U shaped in longitudinal section through the plane which the rams extend, and extend fully across the opening of the wellbore. The U-shaped seals allow the well pressure to force the seals upward and inward, such that the well pressure energises the seal and tends to keep the rams in a sealed configuration.

Other variations on the ram BOP are available, including rams designed to completely shear through pipe or wireline. In addition, some arrangements are manually operated rather than hydraulically operated. In this case, the actuators normally consist of large screws and are rotated by use of a large handle to generate the torque required to drive the rams against the well pressure.

Presently available ram type BOPs suffer from a number of deficiencies and drawbacks. In particular, many of the drawbacks arise from the size of the apparatus. Available designs consist of a pair of rams arranged perpendicular to the wellbore, and extending on either side of the wellbore by up to 2.5 meters (around 100 inches). This has significant implications for the construction of well control apparatus at the rig. Ideally, the BOP stack would be located close to the wellhead, to maximise the height above available to accommodate the toolstring. However, in practice, it is difficult to manoeuvre the BOP stack through platforms on the rig structure. A platform on the rig structure would typically have a hole in the grating of around 24 inches diameter (depending on the diameter of pipe passing through). This opening is too small to allow a ram-type BOP to be passed through in its usual upright configuration where the hydraulic actuators are oriented horizontally. This requires the BOP to be manoeuvred carefully such that the cross-axis access is oriented vertically, allowing the BOP to be passed through the opening. This is a difficult and dangerous operation due to the size and weight of the BOP stack. A reduction in weight is limited by the need for large diameter hydraulic rams and high strength steel components.

As an alternative, the platform may be provided with a larger diameter slot to allow the passing of the BOP to be conducted more easily. However, this has implications for the health and safety of personnel working at the platform, and may require installation railings or other barriers to prevent personnel from falling through the slots. It is therefore more usual to install the BOP stack at an elevated height above the wellhead, of in excess of 13 meters (40 feet). The consequence is that a greater overall height of well control apparatus is required, or alternatively restrictions are placed on the length of tool string available. This deficiency is particularly important for concurrent operations.

Existing BOP designs suffer from other deficiencies. These include problems with the structural strength of the ram. The ram blocks located on either side of the wellbore will typically include a recess and protrusion which cooperate to ensure that the ram blocks are appropriately aligned. The recess formed on a ram will reduce the structural strength in the ram. Moreover, the recess may in fact be formed on an outer surface of the ram, meaning that as the ram is sealing it has a portion that is unsupported. The ram is therefore "floating" rather than being fully supported by the body of the BOP. This can also result in deformation of the ram, impacting on its application to high pressure BOPs.

The arrangement of a typical ram BOP can also cause difficulties in guiding the pipeline or wireline to the right part of the ram block formation (i.e. the cut-out formation). These difficulties arise in part due to the problems with keying the rams appropriately. In addition, typically the piston assembly on one side of the wellbore will be slightly looser than the opposing ram, resulting in the loose piston assembly being driven to the full extent of its travel before the opposing piston assembly begins to move. This increases the probability of the wireline or pipeline being snagged or damaged by the guiding profile. This can damage the wireline or pipeline and in severe cases cause it to be sheared.

A further deficiency of typical ram-type BOPs is the time taken to actuate the rams, due to the high volume hydraulic cylinders, or worse, the time required to manually close the rams. This has safety implications.

The present applicant has identified the need for an improved valve design, and in particular an improved BOP design that differs significantly from a conventional ram type BOP.

It is a first aim of the invention to provide an apparatus suitable for sealing a bore that obviates or at least mitigates some of the drawbacks and deficiencies of available valves and/or BOPs. In particular, it is an aim of at least one aspect of the invention to provide an improved valve or BOP for sealing around a wireline, pipeline or conduit in a wellbore.

It is a further aim of the invention to provide apparatus for sealing a wellbore of reduced external size, and in particular apparatus of lesser lateral dimension and reduced weight when compared with a typical ram type BOP.

A further aim of the invention is to provide apparatus for sealing a wellbore, where the apparatus has a reduced requirement for hydraulic actuation when compared with a typical ram type BOP.

Further aims and objects of the invention will become apparent from the following description.

SUMMARY OF THE INVENTION

According to a first aspect of the invention, there is provided apparatus for sealing a wellbore, the apparatus comprising a ram assembly having a pair of rams rotatably mounted in a housing and actuating means, the apparatus having a first open position in which fluid may pass through the wellbore and a second closed position in which the rams abut to seal the wellbore, wherein the apparatus is moved between the open and closed positions by rotating the rams.

In the context of this description, the word ram should not be taken to imply a linear movement of components, as with conventional ram-type BOPs. The rams and ram assemblies described herein are analogous to the rams in a conventional ram-type BOP in the sense that they move together to abut and form a seal. References to rams should be taken to mean assemblies, components, members or blocks which are moveable to a position in which they form an obstruction in the wellbore.

Preferably, the apparatus has a maximum lateral dimension of 80 cm.

Preferably, the maximum lateral dimension is less than 50 cm.

Preferably, the maximum lateral dimension is less than 40 cm.

According to a second aspect of the invention, there is provided apparatus for sealing a wellbore around a wireline or pipeline being run in the wellbore, the apparatus comprising a ram assembly and actuating means, wherein the apparatus comprises a first position in which the wellbore is open and a second position in which the wellbore is closed, wherein the actuating means causes the ram assembly to rotate from its first open position to its second closed position in which the wellbore is sealed around the wireline or pipeline.

According to a third aspect of the invention there is provided a apparatus for sealing a wellbore, the apparatus comprising a pair of rams moveable from a first position in which the wellbore is open and a second position in which the rams seal the wellbore around a wireline or pipeline, characterised in that when the apparatus is in its operating orientation, the apparatus has a maximum lateral dimension which allows it to pass through an aperture in a rig platform through which the wellhead control equipment passes.

Preferably, the maximum lateral dimension is less half of the maximum lateral dimension of a ram-type BOP operating on an equivalent diameter wellbore at equivalent well pressure.

Preferably, the maximum lateral dimension is less a third of the maximum lateral dimension of a ram-type BOP operating on an equivalent diameter wellbore at equivalent well pressure.

Preferably, the maximum lateral dimension is less than 80 cm.

Preferably, the maximum lateral dimension is less than 50 cm.

Preferably, the maximum lateral dimension is less than 40 cm.

According to a fourth aspect of the invention there is provided a apparatus for sealing a wellbore, the apparatus comprising a pair of rams moveable from a first position in which the wellbore is open and a second position in which the rams seal the wellbore around a wireline or pipeline, characterised in that when the apparatus is in its operating orientation, the apparatus has a maximum lateral dimension of less than 80 cm.

Preferably, the apparatus comprises a pair of rams rotatably mounted in a housing and actuating means, wherein the apparatus is moved between the open and closed positions by rotating the rams.

According to a fifth aspect of the invention, there is provided apparatus for sealing a wellbore, the apparatus comprising a ram assembly having a pair of rams, and actuating means, the apparatus having a first open position in which fluid may pass through the wellbore and a second closed position in which the rams abut to seal the wellbore, wherein the rams are moved from the first and second positions without substantially changing the volume of the actuating means exposed to well pressure.

Preferably, the apparatus comprises a pair of rams rotatably mounted in a housing and actuating means, wherein the apparatus is moved between the open and closed positions by rotating the rams.

According to a sixth aspect of the invention there is provided a blowout preventer comprising a ram assembly having a pair of rams rotatably mounted in a housing, the blowout preventer having a first open position in which fluid may pass through the wellbore and a second closed position in which the rams abut to seal the wellbore, wherein the blow out preventer is adapted to be moved between the open and closed positions by rotating the rams.

The following statements reflect optional features of any of the first to sixth aspects of the invention.

Optionally, the rams comprise formations for locating a wireline or pipeline in the closed position.

Preferably, the apparatus comprises alignment means for guiding a wireline or pipeline towards the centre of the wellbore during rotation of the rams.

More preferably, the apparatus comprises alignment means for guiding a wireline or pipeline towards the formations during rotation of the rams.

The alignment means may be a drum adapted to rotate about the axis of rotation of a ram.

The drum may comprise a throughbore of a first diameter, through which the wireline or pipeline extends.

Preferably, the throughbore defines an aperture which decreases in cross sectional area during rotation of the drum.

Preferably, the throughbore is perpendicular to the axis of rotation of the drum.

The first diameter is preferably equal to or greater than the inner diameter of the wellbore.

Preferably, a first opening of the throughbore is provided with a channel formed outwardly from an edge of the throughbore.

More preferably, a second opening of the throughbore is provided with a formation on its edge, diametrically opposed from the channel.

The formation may be a second channel formed outwardly from an edge of the throughbore, such that the first an second channels together form an aperture extending through the drum perpendicular to the axis of rotation.

The aperture may extend through the axis of rotation of the drum.

Preferably, the aperture is aligned with the formations for locating a wireline or pipeline in the closed position.

Alternatively, the formation is a cutting edge adapted to shear a wireline or pipeline as the apparatus moves to its closed position.

Preferably, each ram comprises a sealing assembly having one or more elastomeric seals.

More preferably, the sealing assembly comprises an inner seal adapted to cooperate with an inner seal on the opposing ram to seal against the wireline or pipeline.

More preferably, the sealing assembly comprises an outer seal adapted to seal edges of the wellbore against well pressure.

Optionally, the inner seal is retained on the ram by the outer seal.

Preferably, the apparatus is hydraulically actuated.

Optionally, the apparatus is provided with a manual override mechanism.

Alternatively, the apparatus is manually actuated.

According to a seventh aspect of the invention there is provided a method of configuring pressure control equipment at a rig, the method comprising the steps of:

Providing a blowout preventer at the rig, the blowout preventer comprising a pair of rams moveable from a first position in which the wellbore is open and a second position in which the rams seal the wellbore around a wireline or pipeline;

Passing the blowout preventer through an aperture in a rig platform while the blowout preventer is in its operating orientation;

Installing the blowout preventer on the pressure control equipment.

According to a eighth aspect of the invention there is provided a method of sealing a wellbore, the method comprising the step of rotating a pair of rams in a ram assembly from a first open position in which fluid may pass through the wellbore and a second closed position in which the rams abut to seal the wellbore.

BRIEF DESCRIPTION OF THE DRAWINGS

There will now be described, by way of example only, embodiments of the invention with reference to the following drawings, of which.

DETAILED DESCRIPTION

Figure 1:
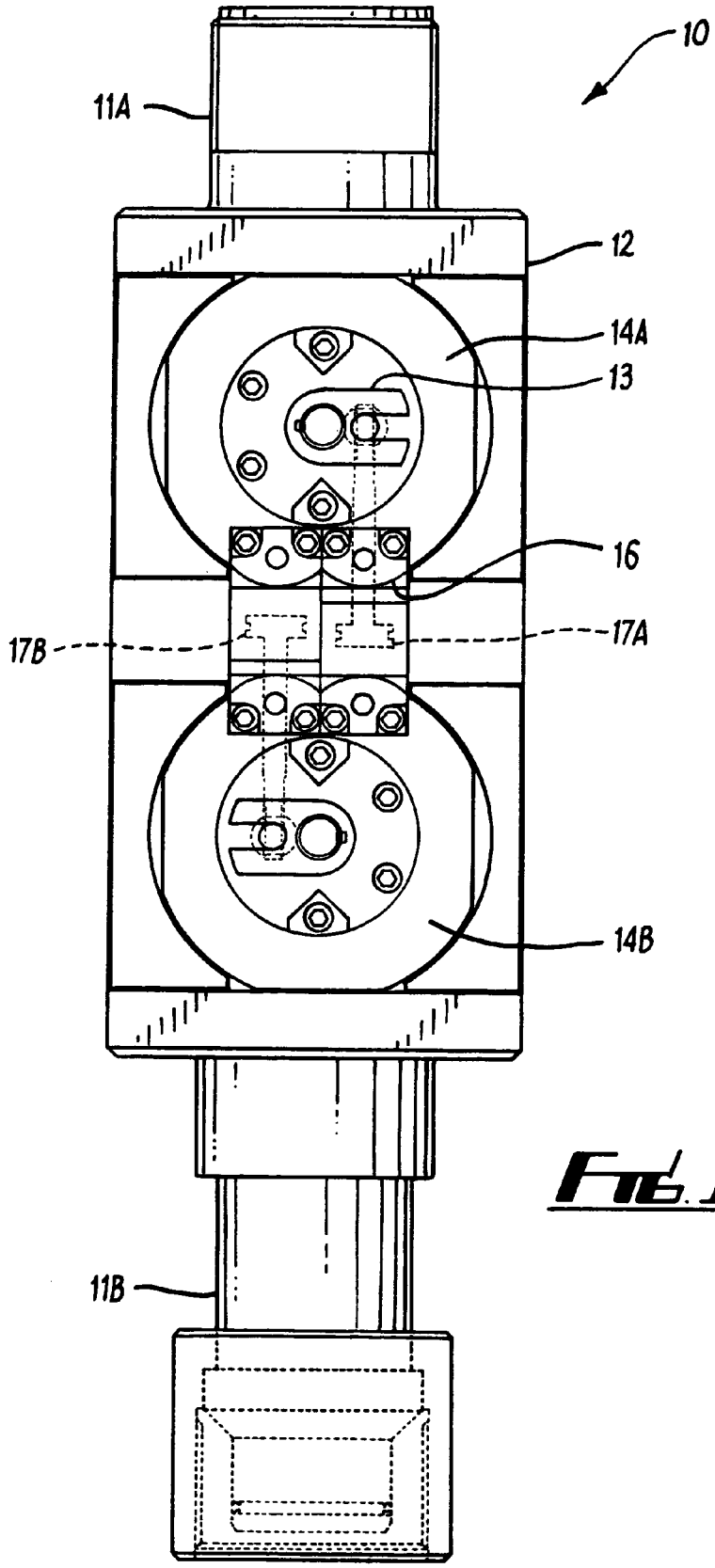
FIG. 1 is a front view of a blow out preventer (BOP) stack in accordance with an embodiment of the invention.

Referring firstly to FIGS. 1 to 4, a first embodiment of the apparatus of the invention is shown, implemented as a blow out preventer (BOP) stack, generally depicted at 10. The BOP stack comprises a pair of BOPS, shown generally at 14A and 14B. The BOPs are contained within a main body 12, which contains a lower tubular 11B for connecting the apparatus to, for example, a riser, and an upper tubular section 11A for connection to, for example, a lubricator stack.

It will be appreciated that although the drawing shows a dual BOP stack, the BOP can also be used in a single, triple, or other multiple configuration.

Figure 4:
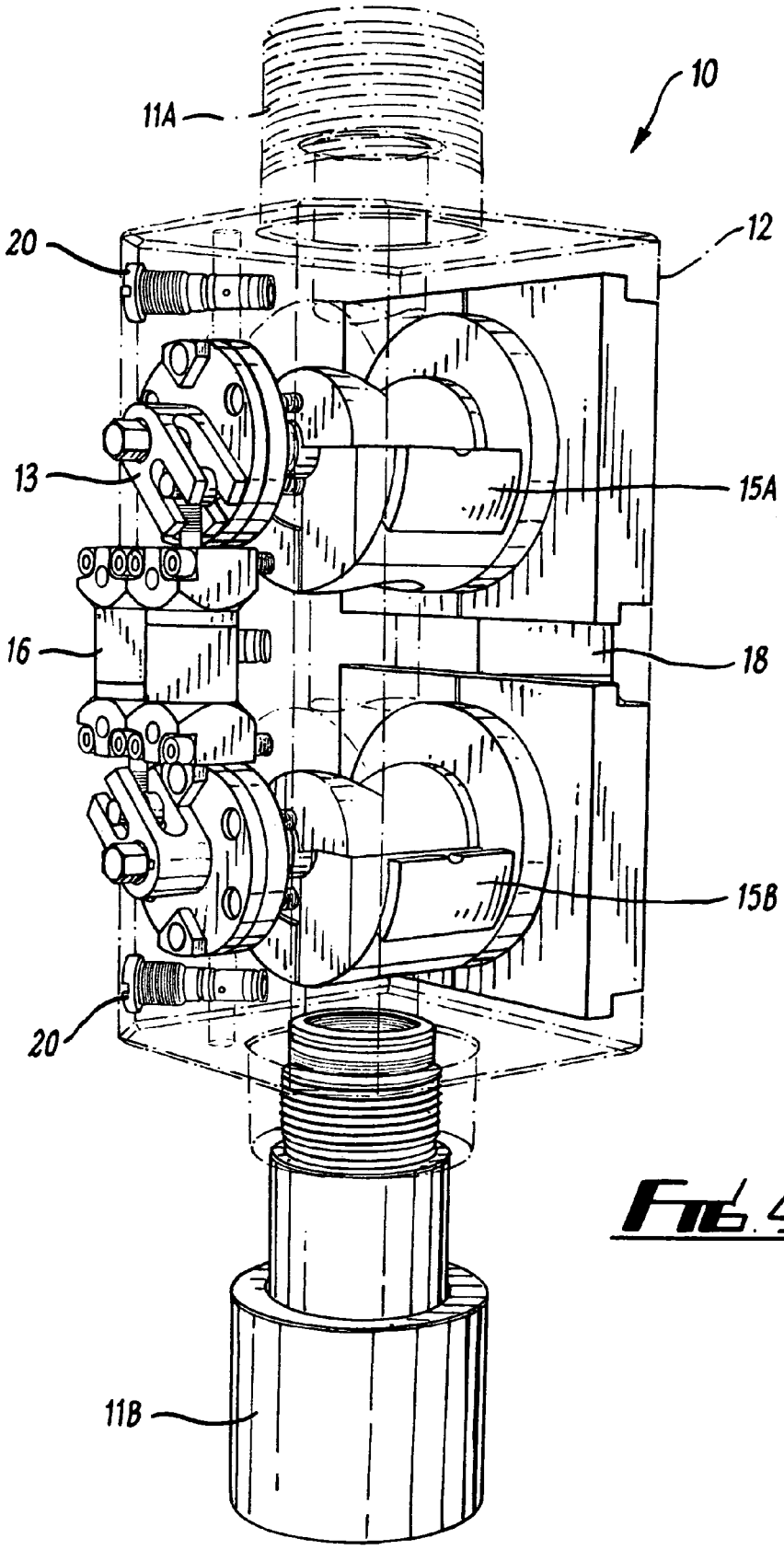
FIG. 4 is a perspective view of the embodiment of FIG. 1, showing the main body of the BOP being partially transparent to display internal components.

As most clearly shown in FIG. 4, the BOP stack houses an upper ram assembly 15A and a lower ram assembly 15B, housed in cylindrical cavities oriented in the Y-axis perpendicular to the main wellbore axis Z.

Actuator assemblies 16 and 18 are provided on front and rear sides of the apparatus respectively, each actuator assembly including a pair of hydraulic pistons. In this embodiment, actuator assembly 16 includes one piston 17A which functions to actuate a ram of assembly 15A, and one piston 17B functioning to actuate a ram of assembly 15B. Similarly, actuating assembly 18 comprises pistons 19A and 19B, respectively functioning to actuate opposing rams in ram assemblies 15A and 15B. In each case, the pistons are coupled to the rams by scotch yoke type actuators 13, although it will be appreciated that other arrangements could be adopted.

Also shown in FIGS. 1 to 4 are equalising spool subassemblies 20, located on the diagonal of the body 12. These allow the controlled release of well pressure prior to moving the ram assembly from a closed back to an open position. FIGS. 1 to 4 also show 3 injection ports 22 allowing fluid to be injected into the cylindrical sections of the BOP stack.

FIG. 4 also shows positioning of the ram assemblies 15A and 15B. In FIG. 4, both ram assemblies 15A and 15B are shown in their fully open positions. The actuation mechanism will be described in more detail below.

Figure 5A:
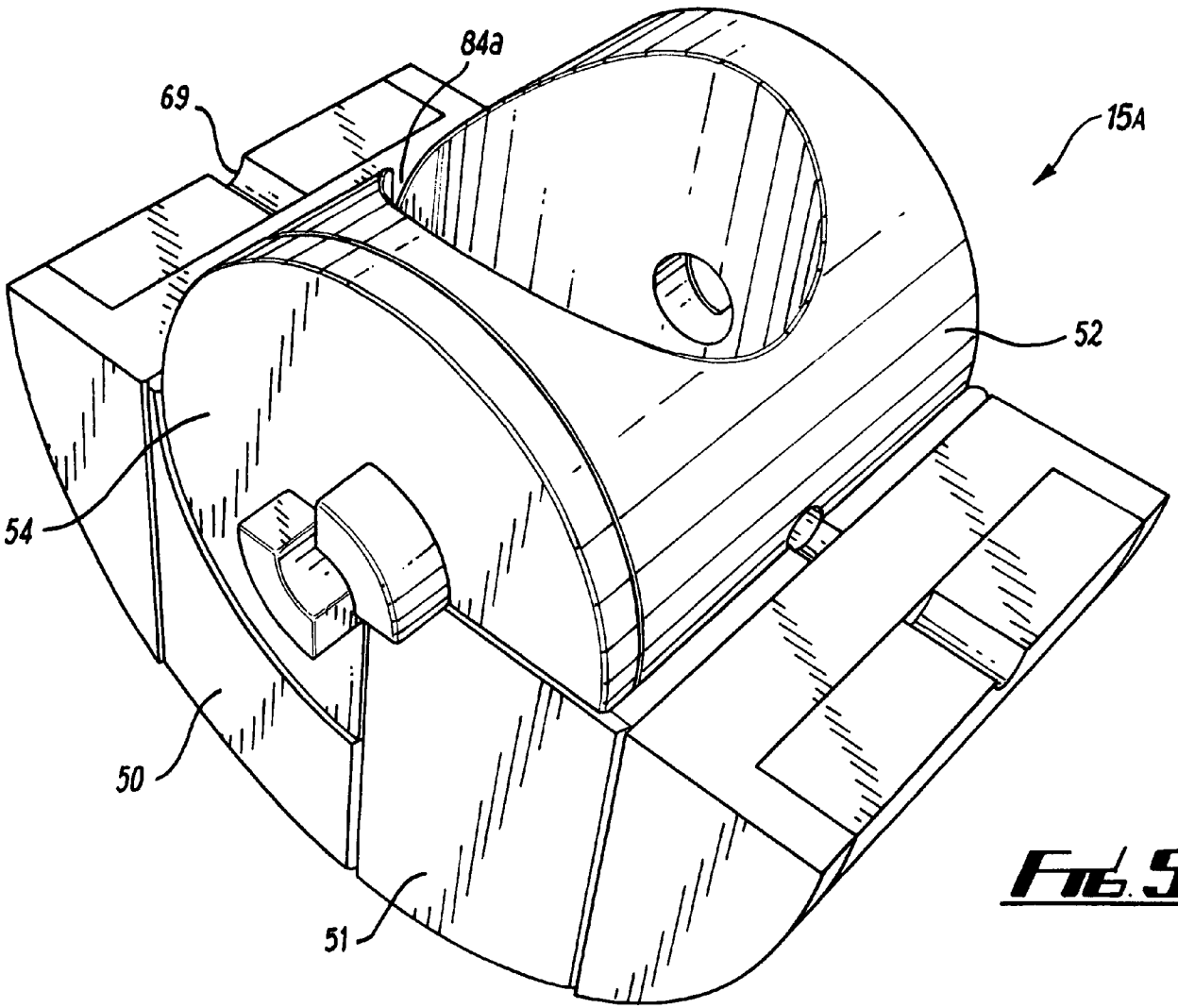
FIG. 5A is a perspective view from one side and above of the ram assembly in accordance with an embodiment of the invention, shown in its open position.
Figure 5B:
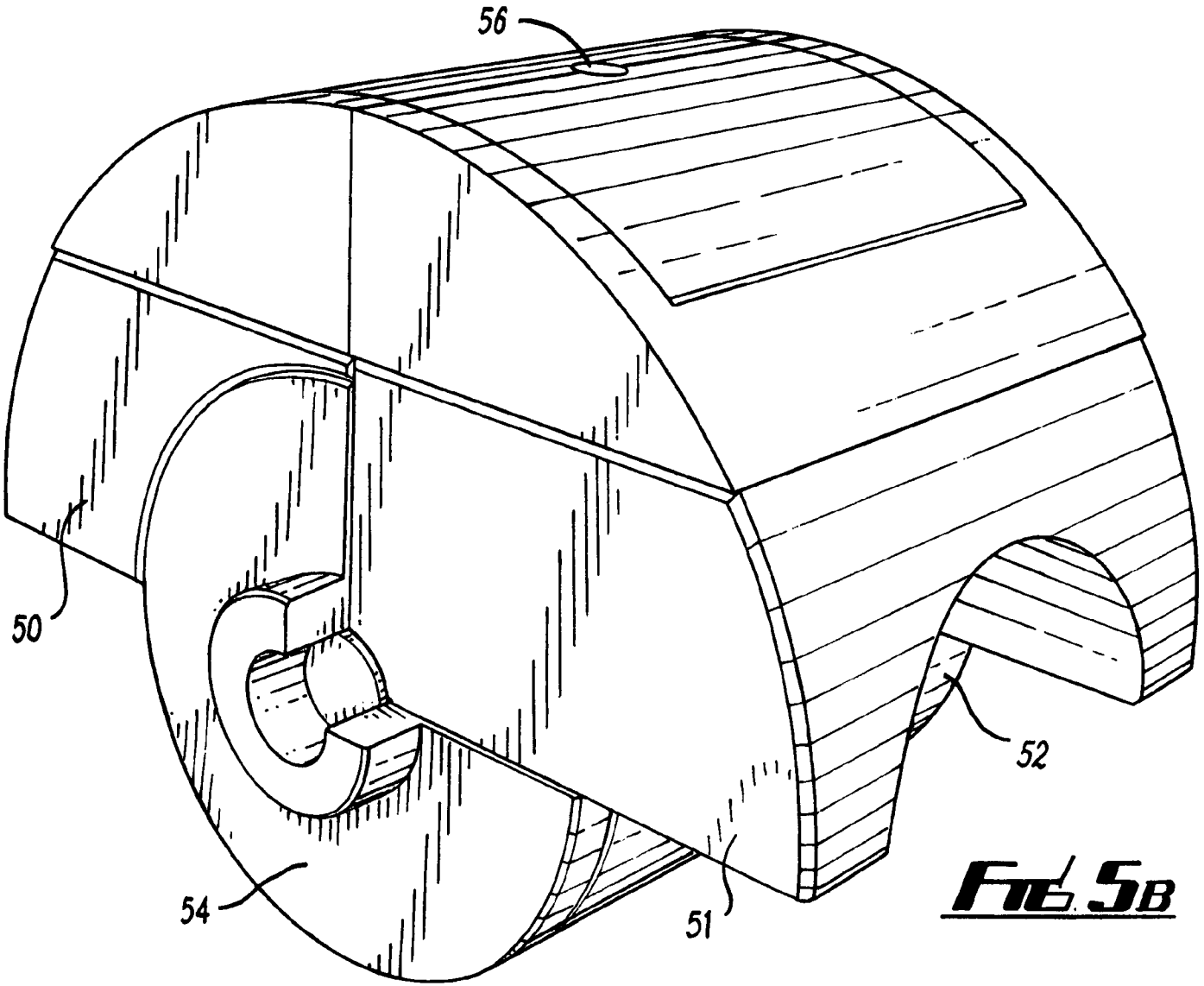
FIG. 5B is a perspective view from above and one side of the ram assembly of FIG. 5A, shown in its closed position.

FIGS. 5A and 5B show components of the ram assembly 15A in more detail. The main body and actuators of the BOP have been removed for clarity. The ram assembly comprises a pair of rams 50, 51, an alignment drum 52, and a ram key plate 54. The individual components of the ram assembly are shown in FIGS. 6A to 6D.

FIG. 5A shows ram assembly 15A in an open position, whereas FIG. 5B shows ram assembly 15A in a closed position.

Figure 6A:
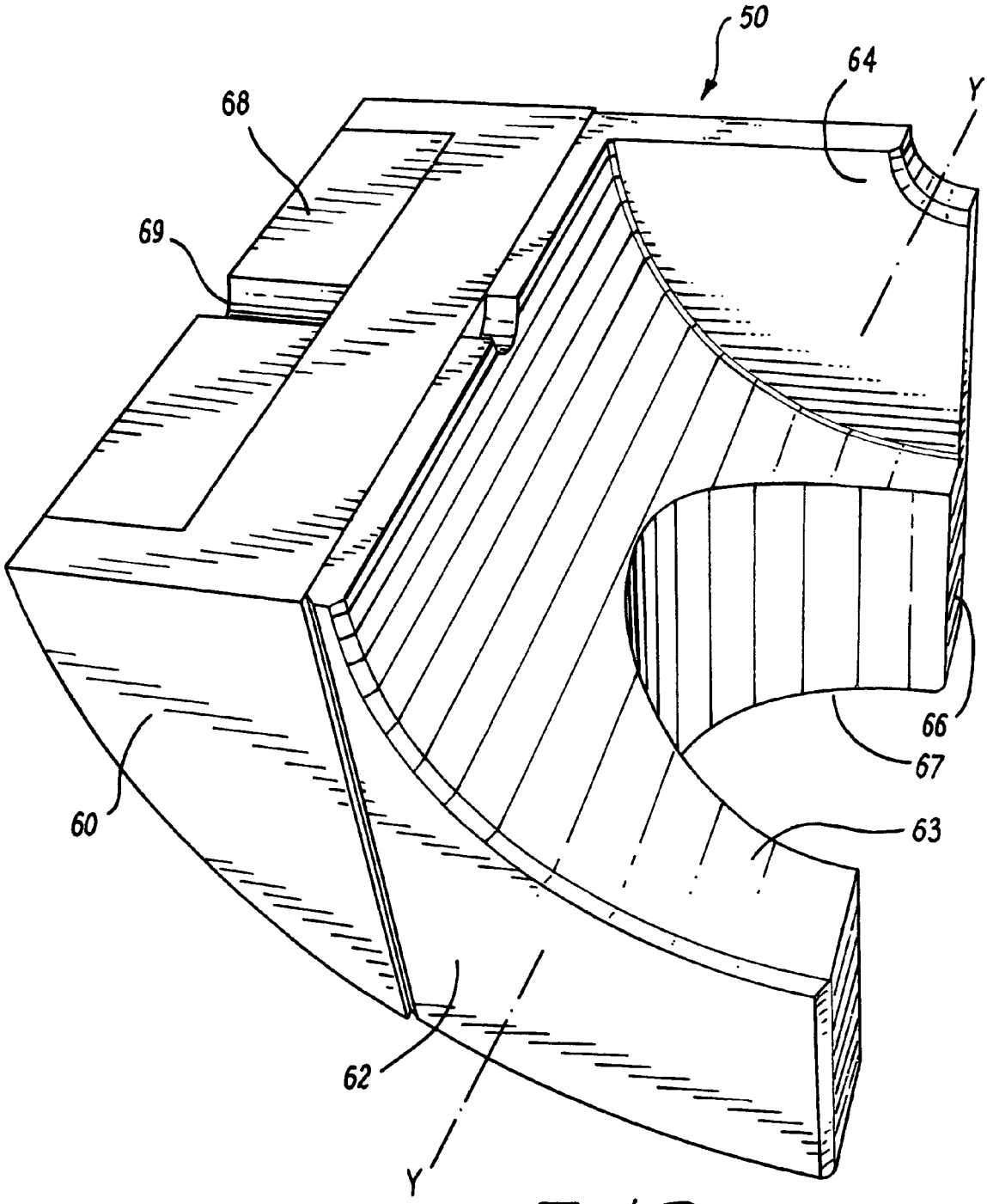
FIG. 6A is a perspective view of a ram of the embodiment of FIGS. 4 and 5.

FIG. 6A shows an individual ram 50, having a sealing assembly 60 mounted thereon. The ram 50 comprises a main body 62 which is formed from a cylindrical quadrant with main axis Y. In use, the ram rotates about the main cylindrical axis Y. The ram has an interior section removed, to form a part-cylindrical seat 63 for the alignment drum of the ram assembly. The internal radius of the removed section corresponds to the radius of the alignment drum 52, and is approximately 50% of the total radius of the ram.

The part-cylindrical removed section of the ram 50 does not extend along the entire axial length of the ram. The ram comprises an end plate 64, which is received into a corresponding formation 65 in the alignment drum.

Formed in the lower edge 66 of the ram is a channel 67 extending parallel to the main axis Y of the ram assembly. The bore is semi-circular in cross section so that when the lower edge of corresponding ram 51 is placed adjacent, a circular throughbore is provided. The throughbore is arranged to have inner diameter greater or equal to the inner diameter of the wellbore.

Along an opposing, sealing edge 68 of the ram, an additional channel is formed in the main body of the ram, in the axis perpendicular to the main axis Y of the ram assembly and the channel 69 in the opposing edge. The channel is semi-circular such that when the sealing edge of the opposing ram is placed adjacent, a circular aperture (56, FIG. 5B) is formed in the ram pair.

The ram is provided with a seal assembly 60 comprising an outer seal 71 and an inner seal 73. The inner and outer seal are elastomeric, and are adapted to seal against a wireline when the rams are in a closed position. It should be noted that no recess is formed in the inner seal corresponding to the aperture 56 formed in the ram pair.

Figure 6B:
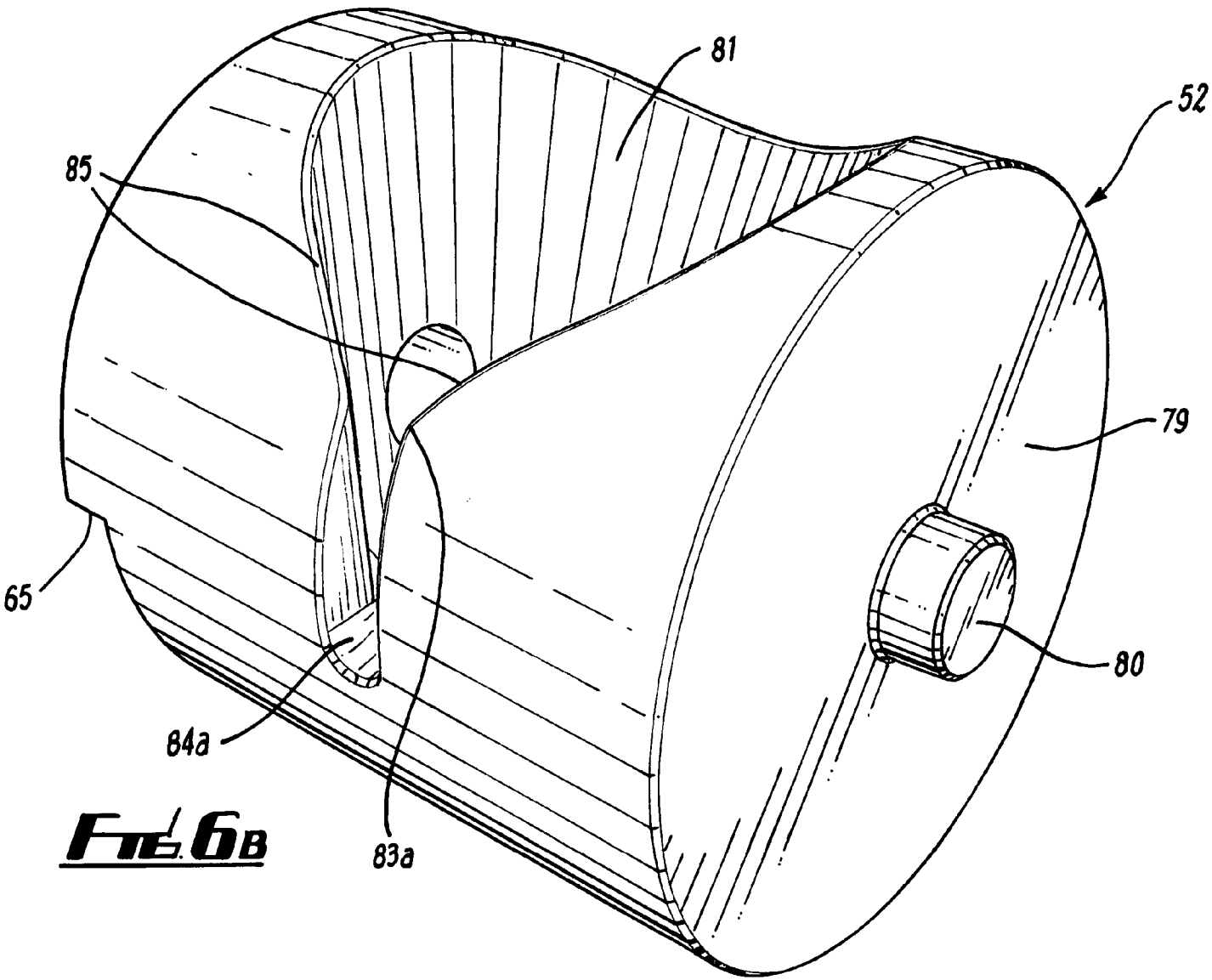
FIGS. 6B and 6C are perspective views of an alignment drum of the embodiments of FIGS. 4 and 5.
Figure 6C:
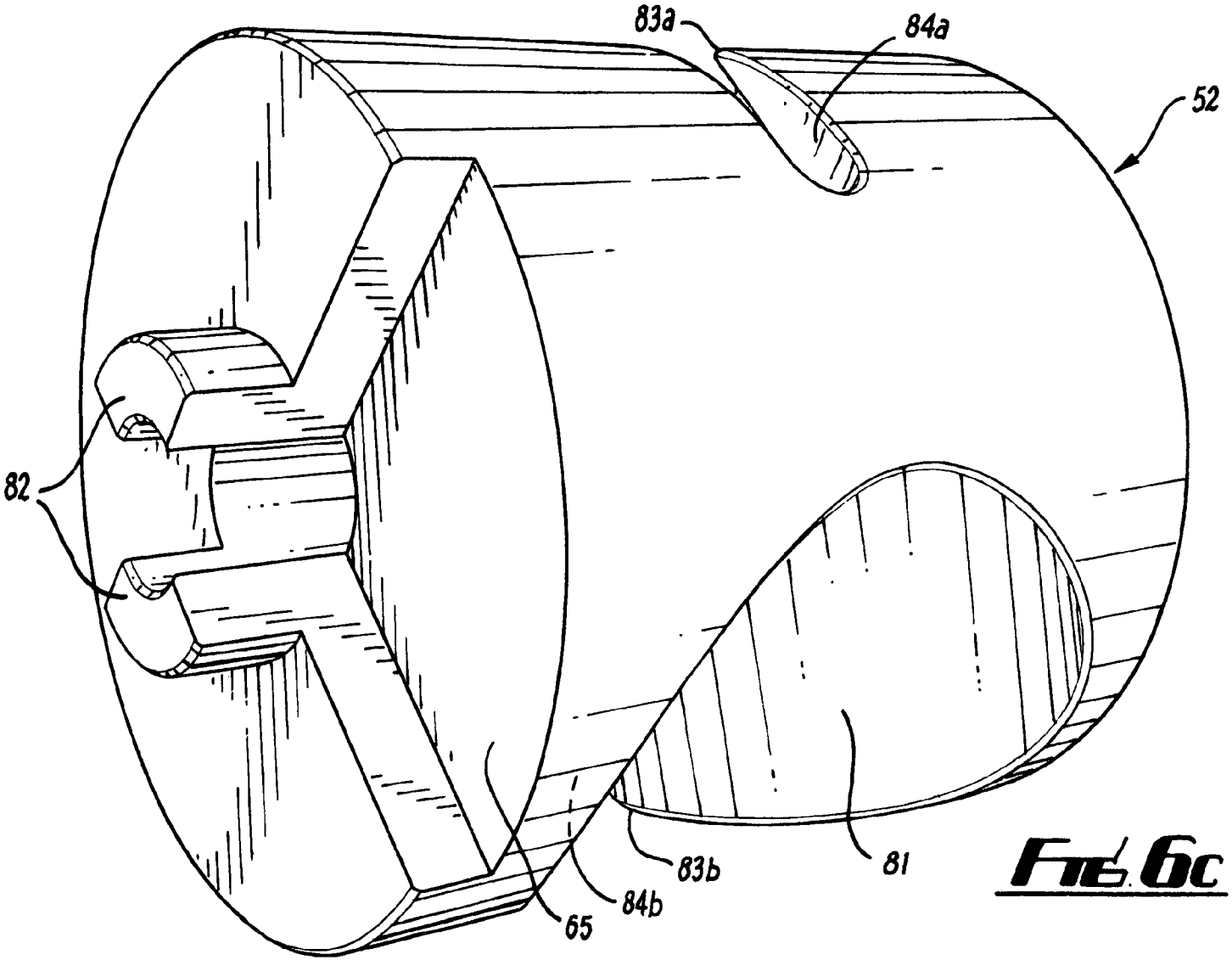

FIGS. 6B and 6C show the alignment drum 52 from two different perspectives. The alignment drum is generally cylindrical, and has a flat end 79 with an axle 80 formed therein. The opposing end of the alignment drum has a section 65 removed. This is a quadrant of axial extent equal to the thickness of the end plate 64 on the ram, and receives the end plate of a ram when the apparatus is assembled. Members 82 are provided for engaging with a spindle of the actuating means.

The alignment drum 52 has a cross-axial bore 81 formed therein. The bore 81 is substantially circular in cross section, with diameter corresponding to the inner diameter of the wellbore. In opposing edges 83*a*, 83*b* of the cross-axial bore, channels 84*a* and 84*b* are formed, extending outwardly from the centre of the cross-axial bore. The channels 84*a*, 84*b* are formed on diametrically opposed sides of the drum, with a diameter less than that of the cross axial bore 81, but large enough to accommodate a wireline or pipeline being run in the wellbore. The channels extend to a distance such that they define another cross-axial bore or aperture passing through the central axis of the alignment drum. The ends of the channels are rounded to provide a smooth surface for the wireline or pipeline. The edge defined by the rim of the main bore and the rim of the channel is shaped to create a smooth, tapered path from the main bore to the channel. In this example, this is by a pair of tangents inclined to one another at around 90 degrees, with smoothed edges where they intersect the channels.

Figure 6D:
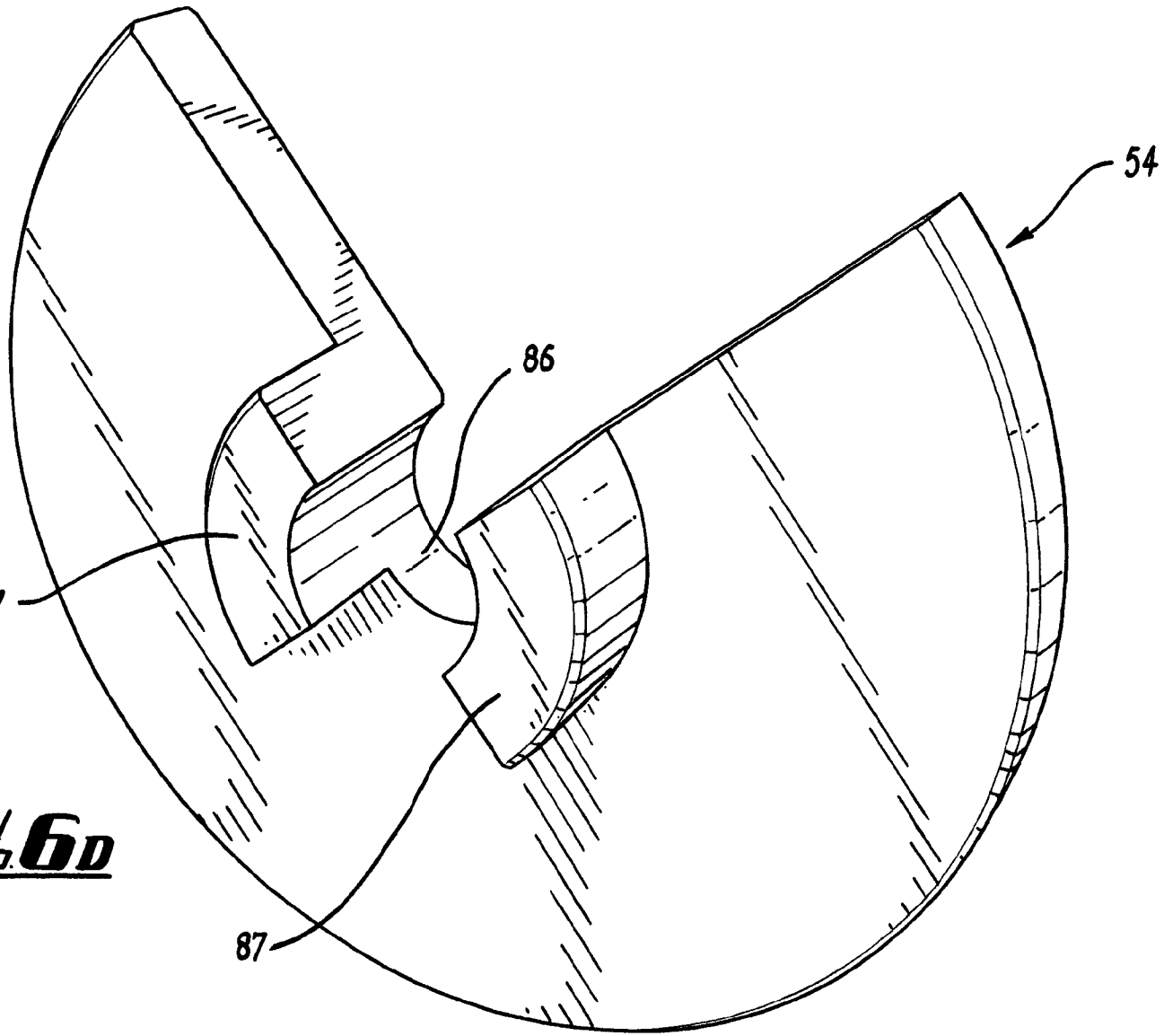
FIG. 6D is a perspective view of a ram key plate of the embodiment of FIGS. 4 and 5.

FIG. 6D shows the ram key plate 54, which is formed to an outer diameter equal to that of the alignment drum 52. The ram plate comprises a central bore 86, which receives the axle 80 of the flat end of the alignment drum 52. The plate 54 is therefore able to rotate with respect to the alignment drum. Members 87 are provided for engaging with a spindle of the actuating means. The plate is a circular disc with a quadrant removed. This quadrant corresponds to the end plate of a ram, and receives the end plate when in the ram assembly.

In its assembled state, the ram assembly is arranged such that the quadrant recess in the alignment drum 52 receives the end plate 64 of one of the rams, ram 50, such that rotation of the drum effects rotation of the ram, and vice versa. In contrast, the opposing ram 51 is able to rotate with respect to the alignment drum 52. However, the ram key plate 54, by virtue of its corresponding quadrant will cause the ram 51 to be rotated along with the ram key plate 54.

Figure 7A:
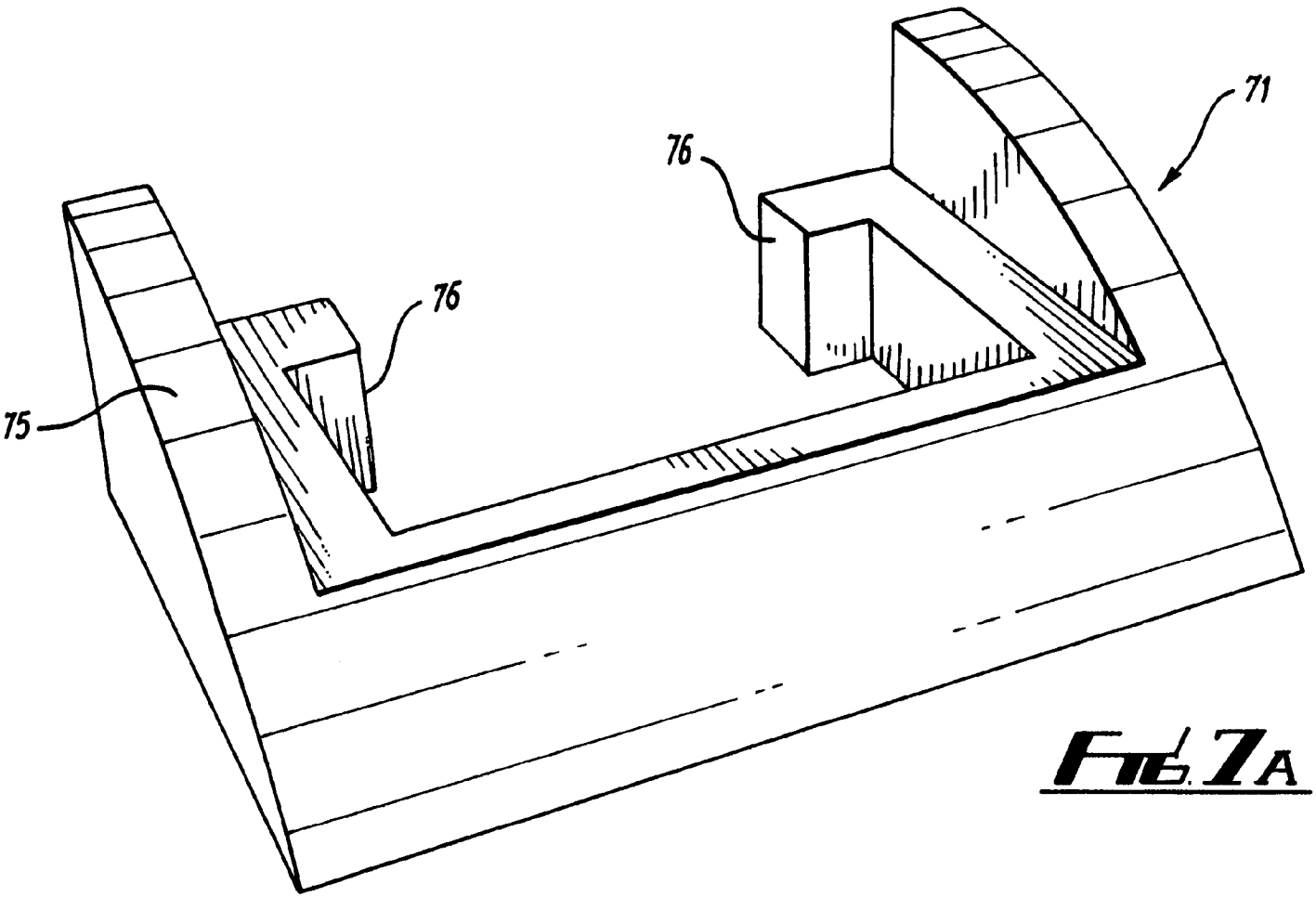
FIG. 7A is a perspective view of an outer seal of a sealing assembly used with an embodiment of the invention.
Figure 7B:
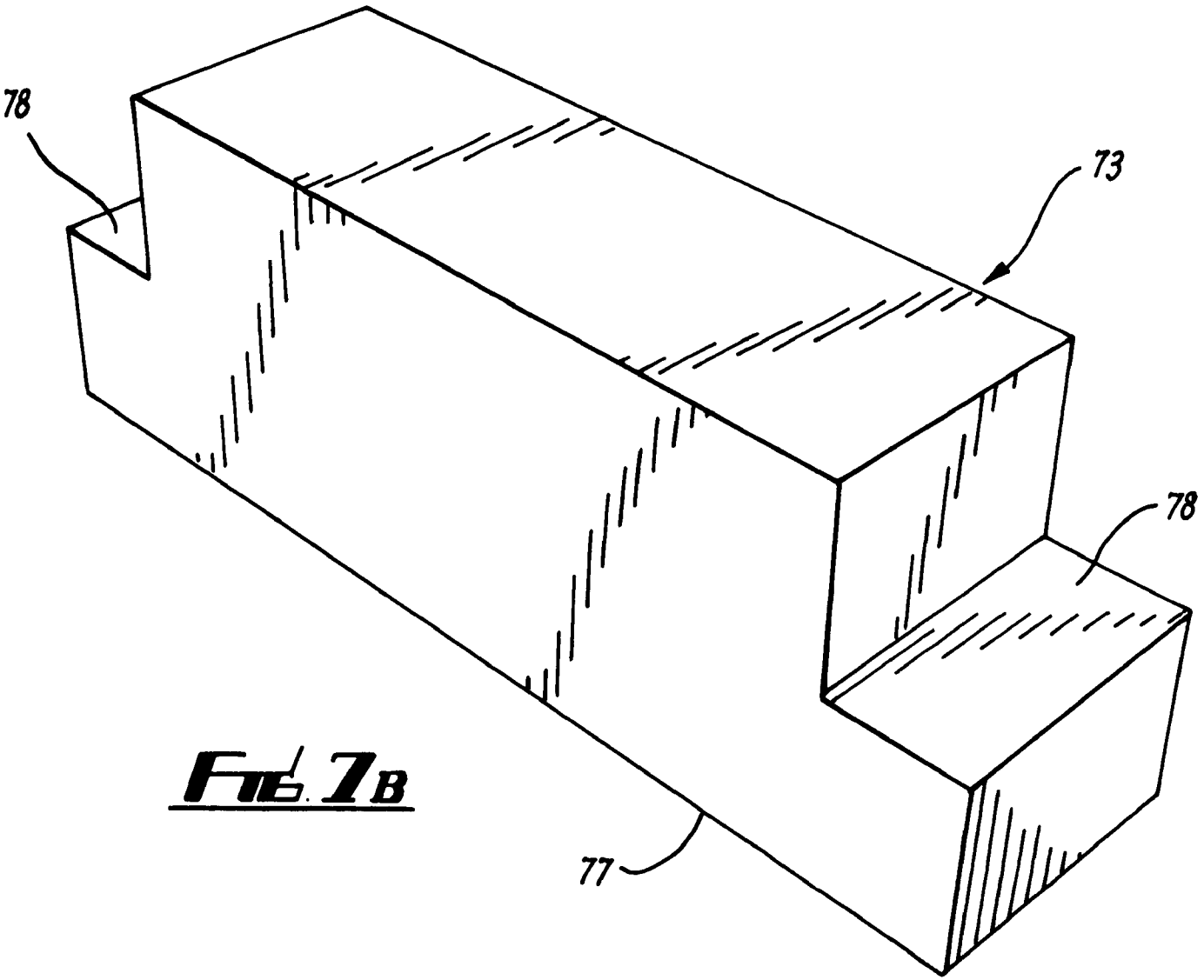
FIG. 7B is a perspective view of an inner seal of a sealing assembly used with an embodiment of the invention.

FIGS. 7A and 7B show components of a seal assembly used with an embodiment of the invention. The seal assembly comprises an outer seal 71 and an inner seal 73, each comprised of elastomeric materials. The outer seal 71 is U-shaped in the plane perpendicular to the sealing surface, and has a curved outer profile 75 shaped to be flush with the outer surface of the ram. Inwardly extending retaining edges 76 are provided at the prongs of the U. The inner seal 73, which in this example is a different material from the outer seal 71, is formed in a broad inverted T-shape. The lower surface 77 of the inner seal 73 abuts a supporting member on the main body of the ram, and the edges 76 of the outer seal fit onto the corners 78 of the inner seal.

The seal arrangement described above is self retaining in the sense that the outer seal secures the inner seal to the ram body. In use, when the rams are closed to seal the wellbore, the extreme force of the well pressure will tend to cause the elastomeric inner seals to stick together. In the prior art, when moving the ram assembly from a closed position in which the inner seals of opposing rams are in contact to an open position in which the rams are separated, the ram blocks will tend to remain in place in the centre of the wellbore unless they are securely fitted to the rams. It is conventional to provide metal inserts moulded in the seals to provide support for screws or bolts used to attach the seal to the ram. In the embodiment of the present invention, the outer seal provides the retention force for the inner seal, removing the requirement for screws and metal inserts. This simplifies the process for manufacturing the seals, which may be by a simple injection moulding process.

In the start position, shown in FIG. 4, the pair of rams occupies the lower half of the cylindrical cavity in the BOP body. In this position, the cross axial bore of the alignment cylinder is aligned with wellbore. In addition, the bore defined by the semicircular channels 67 in the lower edges of the rams is in alignment with the main wellbore, and the rams are in an open position.

In use, with reference to FIGS. 1 and 4, the piston 17A is actuated, causing rotation of the scotch yoke type actuator, which is coupled to the alignment drum. This effects rotation of the alignment drum 90 degrees in an anti-clockwise sense from the perspective of FIG. 1. Simultaneously, the corresponding piston 19*a* on the rear face is actuated and causes rotation of the ram plate. The cooperating quadrant formation engages with the ram causing the ram to be rotated 90 degrees in a clockwise sense from the perspective of FIG. 1.

After actuation, the two rams occupy the volume of the top half of the cylindrical cavity in the BOP body. In this position, the sealing edges 68 of the ram are located together. The outer seals 71 seals around the edge between the body of the cavity and the main wellbore, and the inner seals 73 seal against the wireline or pipeline extending through the wellbore. The shape of the seal assembly is such that the apparatus is self-energising, as well pressure tends to force the seals upward and inwards, causing the seal to be maintained.

FIGS. 8A to 8D show the operation of the embodiment of FIGS. 5 and 6 in more detail, and in particular show the function of the alignment drum.

Figure 8A:
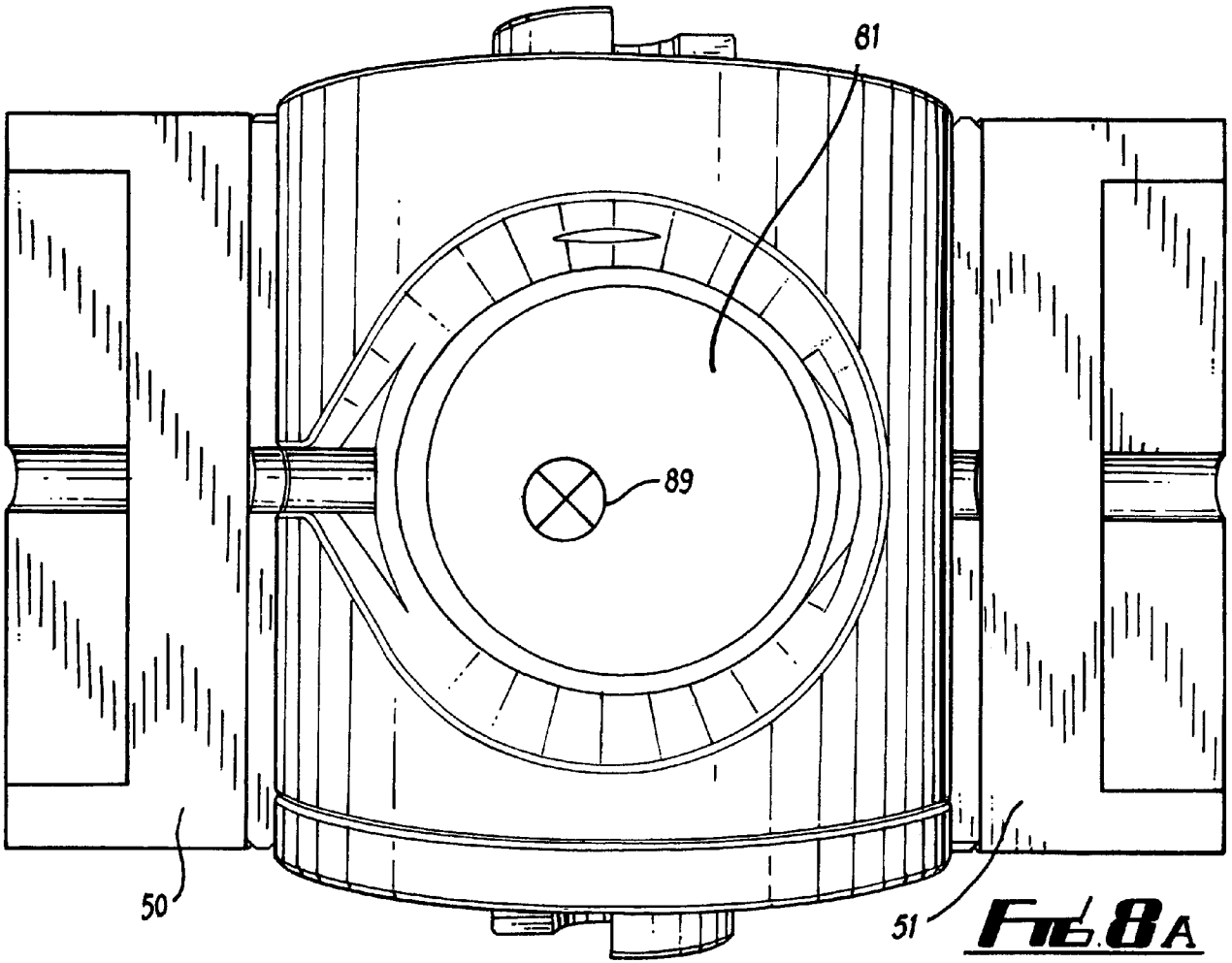
FIG. 8A is a plan view of the ram assembly of the embodiments of FIGS. 4 and 5 in a fully open position.

FIG. 8A is a plan view of the ram assembly in its open position. In this position, the rams 50, 51 occupy the bottom half of the cylindrical cavity in the BOP body. The Figure shows the throughbore 81 fully aligned with the wellbore. In addition, the semi circular channels 67 formed in the lower edges of the rams provide full clearance of the rams from the wellbore. The wireline 89 extends through the bore defined by the cross axial bore in the alignment drum and the semi-circular recesses in the lower edges of the rams. In practice, the wireline is unlikely to be perfectly central in the bore.

Figure 8B:
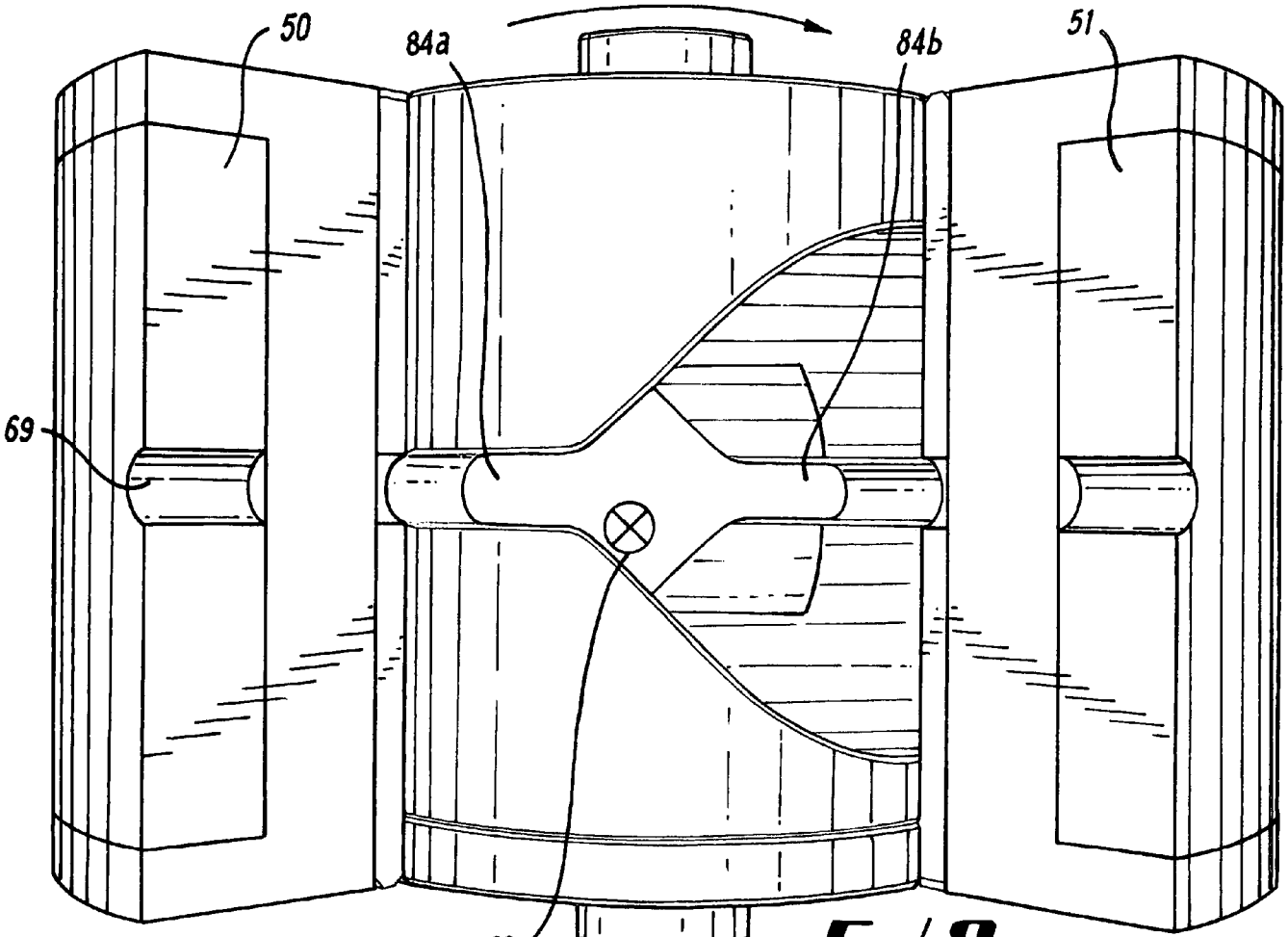
FIG. 8B is a plan view of the embodiment of FIG. 5 in a partially closed position.

FIG. 8B shows the ram assembly partially through its rotation cycle, approximately 50% through rotation. Here, the alignment drum has rotated through around 45 degrees, and the sealing faces of the rams are inclined at approximately 90 degrees to one another. The wireline extends through the aperture defined by the bore and channels formed either side of the bore, which is now in the shape of a square, rotated though 45 degrees, with an elongate channel extending across the diagonal of the square, formed from the channels 84*a* and 84*b* and aligned with the cut-out formations in the sealing edges of the ram.

As the alignment drum continues to rotate in the direction of the arrow, the aperture in which the wireline resides becomes progressively smaller, and the wireline is guided towards the centre of the bore and the locating channels 84*a*, 84*b*. The guiding edges of the bore are shaped to provide a smooth path for the wireline. It is notable that the wireline is guided by the upper guiding edge of the bore, and by the lower guiding edge of the bore simultaneously. This is in contrast to a conventional ram-type BOP, in which the one guiding means on one of the rams moves before the other.

Figure 8C:
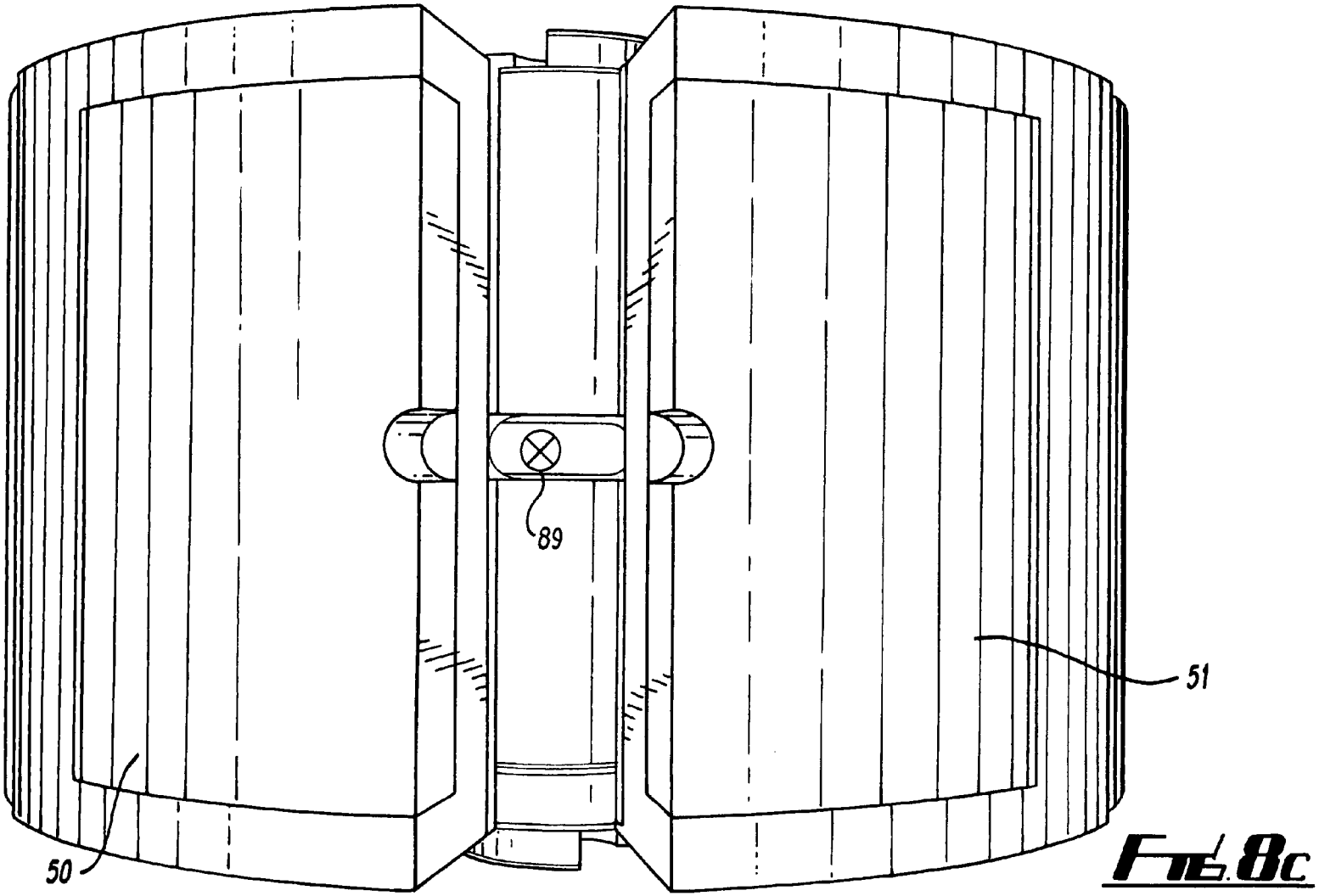
FIG. 8C is a plan view of the ram assembly of the embodiment of FIG. 5 in a partially open position.

FIG. 8C shows the ram assembly almost fully in its closed position. In this position, the rotated square aperture is no longer present, and the aperture is an elongate locating channel aligned with the cut-out formations in the sealing edges of the ram.

Figure 8D:
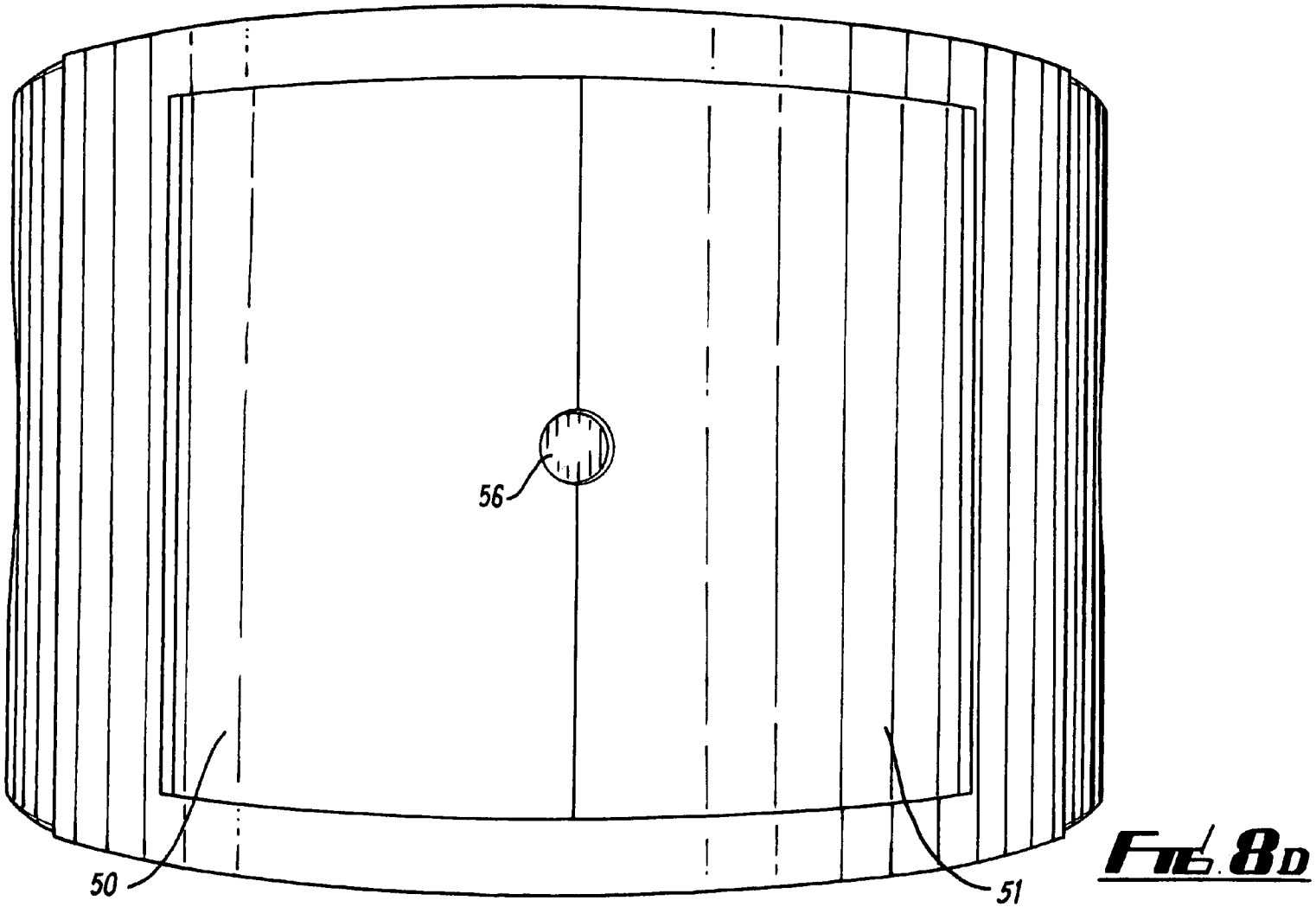
FIG. 8D is a plan view of the ram assembly of FIG. 5 in a fully closed position.

FIG. 8D shows the ram assembly in its fully closed position.

Figure 9A:
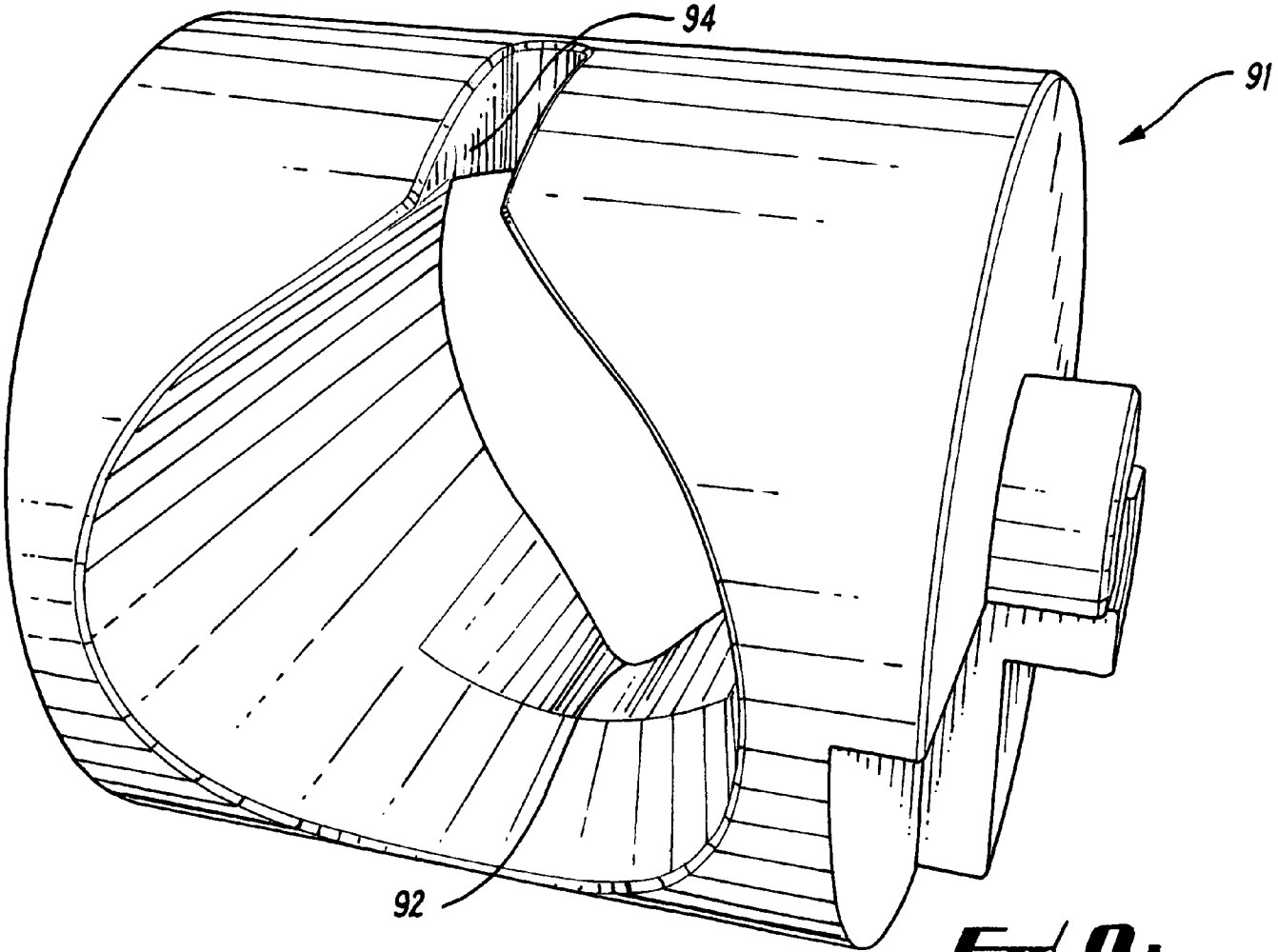
FIGS. 9A and 9B are perspective views of an alignment drum in accordance with an alternative embodiment of the invention.
Figure 9B:
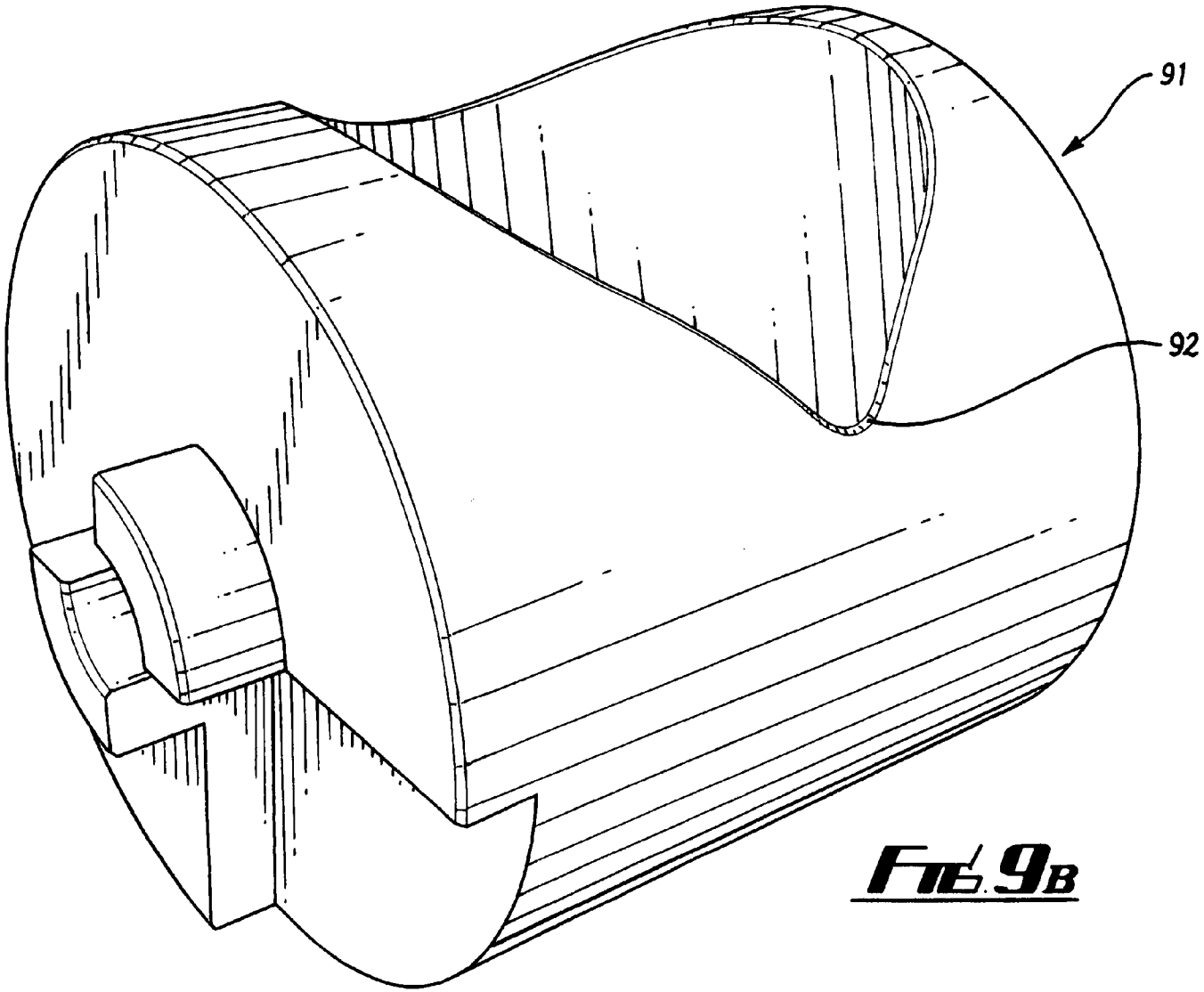

FIGS. 9A and 9B show an alternative embodiment of the invention, in which the alignment drum 91 has shape different from that in the embodiment of FIGS. 5 and 6.

In this example, the invention is implemented as a shear and seal BOP, used when the wireline needs to be cut to release the tool string below. The shearing alignment drum shown in FIGS. 9A and 9B differs from the alignment drum of FIGS. 6A and 6B in that a locating channel 94 is only provided in one edge of the bore in the alignment drum 91, which becomes the lower edge as the drum rotates towards the closed position. This lower edge functions to guide the wireline towards the centre of the bore.

In place of the upper locating channel on the opposing edge, a rounded cutting edge 92 is formed at the intersection of guiding edges. In this example, the guiding edges are two tangents to the bore edges, inclined to one another at around 90 degrees.

Figure 10A:
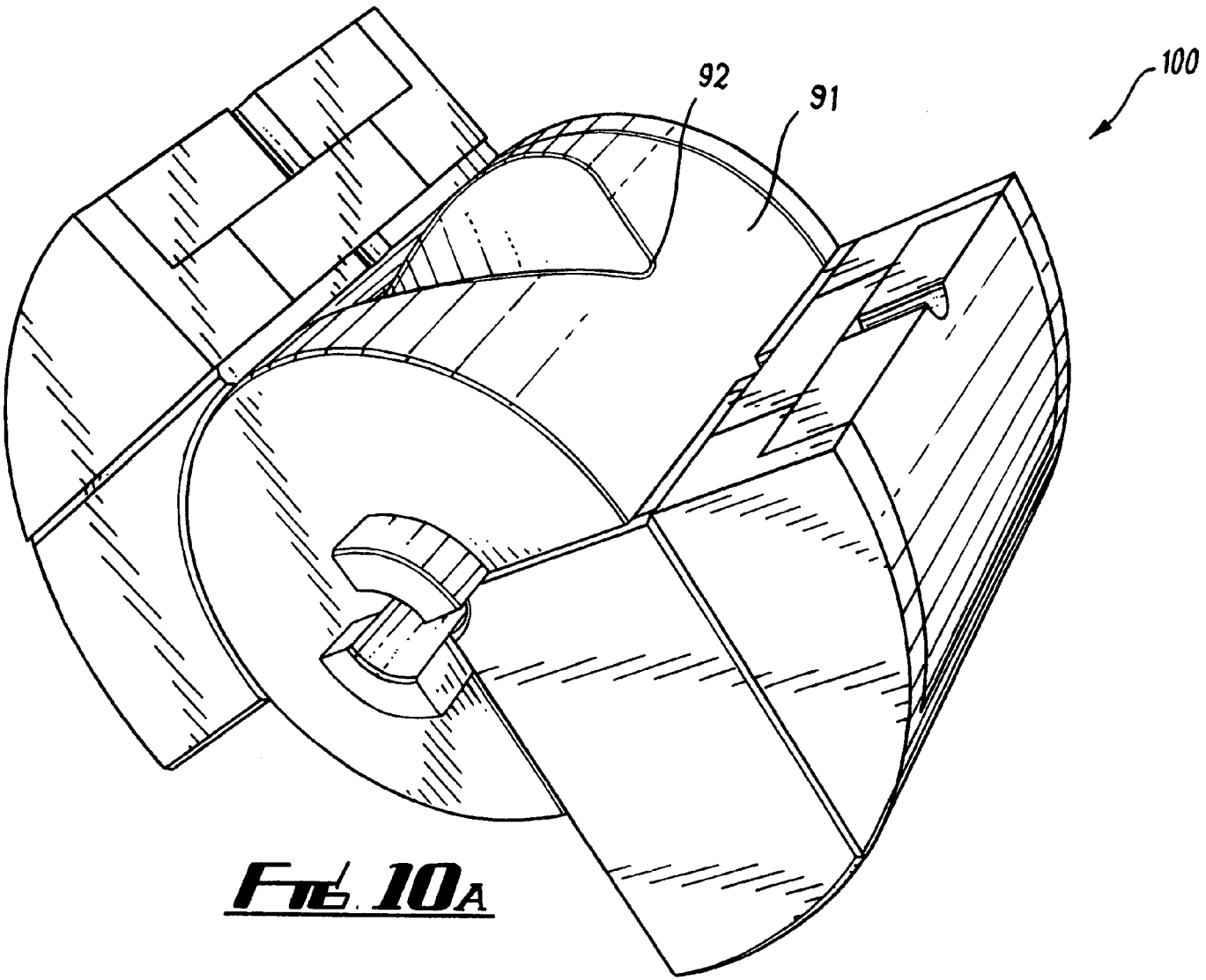
FIGS. 10A and 10B are perspective views of the alignment drum of FIGS. 9A and 9B in a ram assembly in accordance with an embodiment of the invention.
Figure 10B:
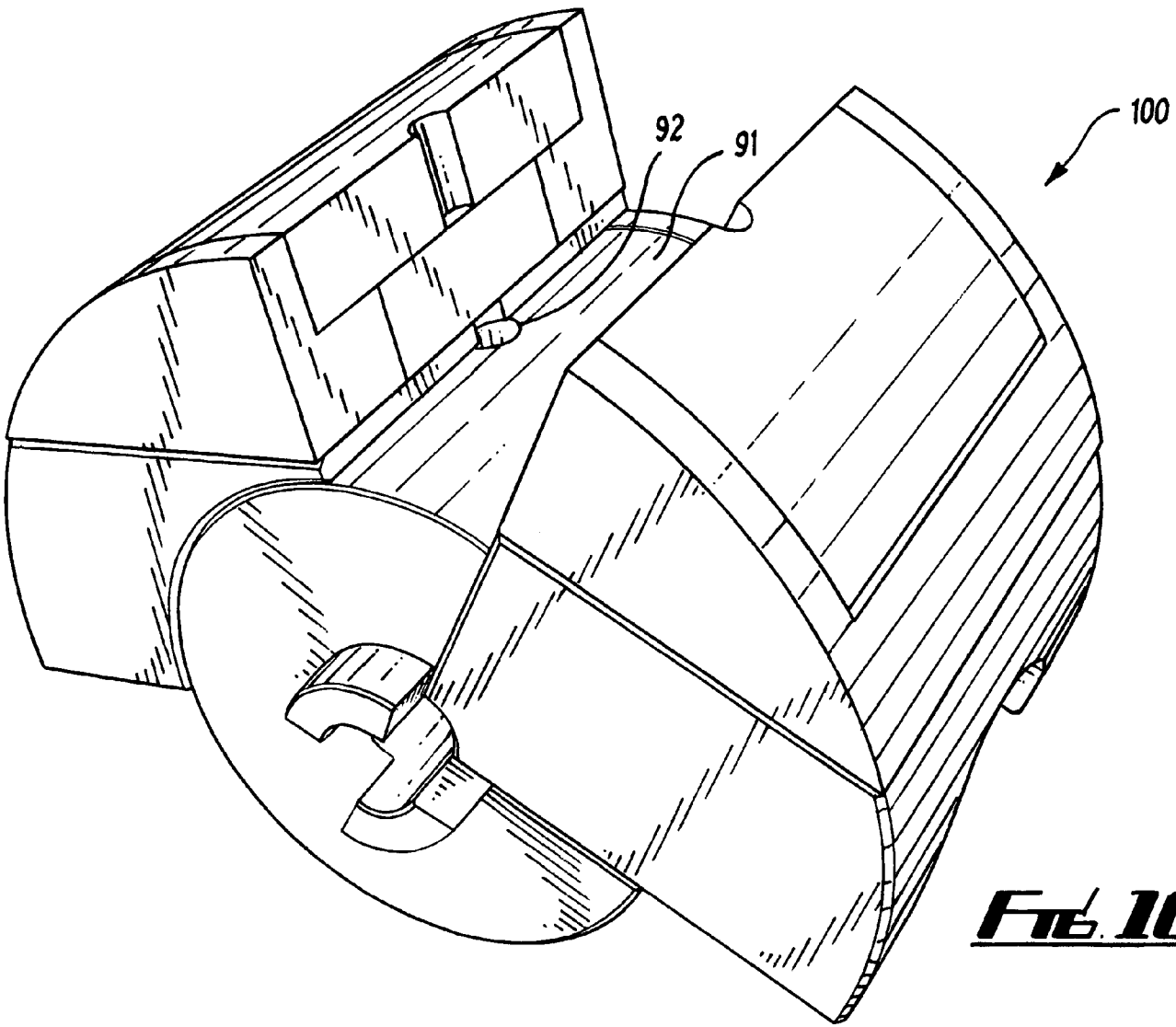

FIGS. 10A and 10B show a ram assembly 100 including the alignment drum 91 at different stages in the rotation cycle. The wireline, guided to the centre of the bore by the lower guiding edges is met by the cutting edge 92 before the drum is fully through its rotation cycle. As the ram assembly proceeds to the fully closed position, the cutting edge shears through the wireline. The wellbore is sealed by the sealing assembly, as described above.

The present invention offers numerous improvements over previously proposed valves.

Firstly, embodiments of the invention introduce a component of the movement of rams in the vertical, rather than lateral dimensions. In the embodiment described, this is achieved by using a circular movement of the rams used to close a conduit. By "wrapping around" the movement of the rams, the lateral extension of the valve components is significantly reduced.

The reduction in lateral dimensions over conventional ram-type BOPs varies according to operating pressure of the BOP and diameter of the wellbore.

For 3 inch diameter wellbore, a 10,000 PSI BOP would be expected to have a maximum lateral dimension of around 30 cm, compared with 110 cm for a conventional ram-type BOP.

For 6 inch diameter wellbore, a 10,000 PSI BOP would be expected to have a maximum lateral dimension of around 60 cm, compared with 190 cm for a conventional ram-type BOP.

In another example, the largest lateral dimension of a BOP stack of the type described is less than 75 cm, compared with around 2.5 meters in an equivalent ram-type BOP.

Figure 2:
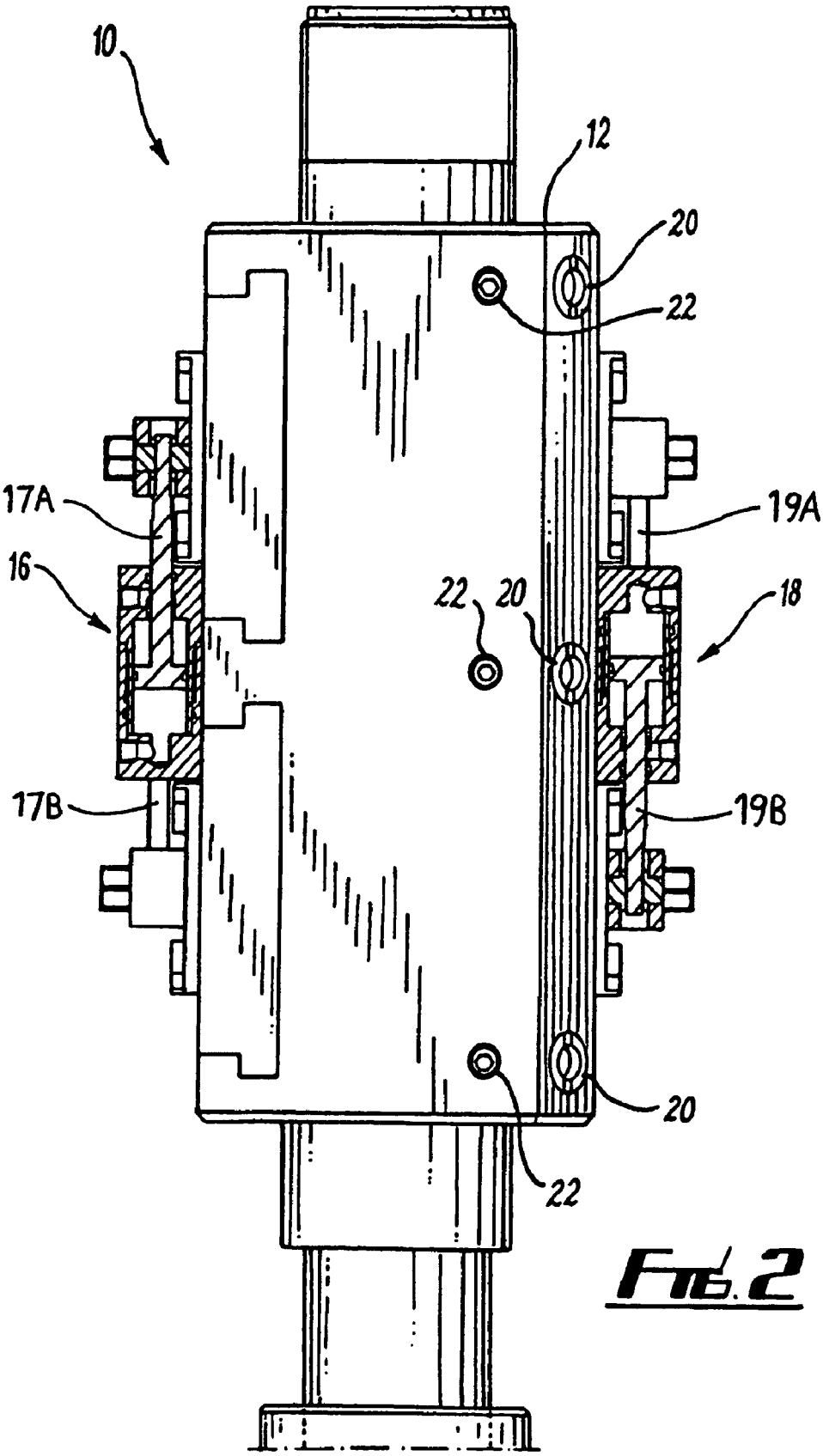
FIG. 2 is a view of the BOP stack of FIG. 1 from a first side, showing longitudinal section through the actuating means.
Figure 3:
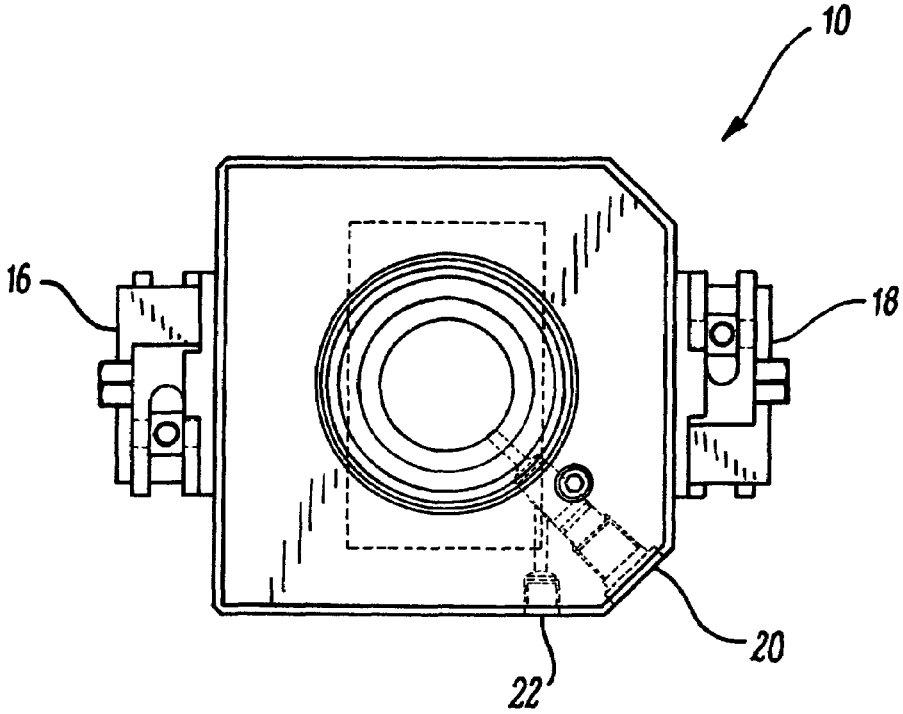
FIG. 3 is a plan view of the apparatus of FIG. 1.

In the example shown in FIGS. 1 to 3, the maximum lateral dimension, including hydraulic actuators, is around 40 cm.

These dimensions are less than half, and indeed less than a third, of the dimensions of the equivalent conventional ram-type BOP.

This improves the manoeuvrability of the apparatus, and allows it to be lowered in, around and through platforms on the rig. Significantly, the BOPs may be installed much closer to the wellhead, having positive effects on the height available for the lubricator stack and the tool string.

The present invention also provides apparatus of reduced weight when compared with conventional ram-type BOPs, which further improves manoeuvrability.

In addition, the ram assembly design is significant in that the rams move from an open to a closed position without changing the volume of components at well pressure. The cylindrical cavities in which the ram assemblies are located are at well pressure when the apparatus is in its open position. When actuated, there is no requirement to force piston-connecting rods into the well volume, in contrast to the conventional ram-type BOP. This feature of conventional BOPs means that there is a requirement to overcome well pressure, which can only be achieved by significant force.

In manually actuated BOPs this requires large screws and large levers in order for the operator to generate enough torque, and this places a huge burden on the operator. In hydraulically actuated systems, there is a requirement for large diameter cylinders, which increases the weight and size of the apparatus. During operation of the present invention, the volume swept by the rams does not change, and the result is that less force is required to actuate the rams. This means that smaller diameter hydraulic actuators can be used. In addition, manually actuated systems are more feasible using the present design. In both manually and hydraulically actuated apparatus, the time taken to close the wellbore is greatly reduced, improving the safety at the rig.

The reduced requirement for hydraulics reduces the need to provide screw locking mechanisms which are typically used in conventional ram-type BOPs to manually secure the rams in their closed configuration after actuation by the hydraulics. In the present design, the apparatus could be locked in one position by a simple peg and hole arrangement in the actuating mechanism and the main body of the BOP stack.

The manner in which the apparatus is constructed is simple, and allows simple installation and stripping down by removal of two plates on one side of the apparatus.

The construction of the apparatus allows convenient location of equalisation channels and injection channels, without conflicting with screws and fittings.

The alignment drum offers a number of advantages over conventional ram-type BOPs.

In the present embodiment, the rams are fully supported around the entire outer surface of the rams. The alignment of the wireline or pipeline is not done by any component of the rams themselves, and thus compromising the strength of the rams by providing recesses on the supporting surface is not necessary.

Alignment of the wireline is by the profiles of the upper and lower edge of the cross axial bore of the drum. The alignment is therefore at two spatially separated locations on the wireline, reducing the likelihood of damage or snagging of the wireline during closing.

In addition, the movement of the guiding edges against the wireline is such that the edges move across the wire while moving a small distance along the wireline as the drum rotates. The force is therefore imparted over a short range of points, rather than being a slicing effect at a single point of the wire. This further reduces the tendency of the wireline to snag.

The movement of the alignment drum to the closed position provides two guiding edges for the wireline, moving in opposite senses, which by their nature must act in concert, as opposed to the guides in the conventional ram-type BOP which are likely to move separately, reducing their effectiveness.

References to wireline applications should not be taken as limiting. The above described apparatus is suitable for sealing a conduit around any wireline, slickline, pipeline, umbilical or cable. Indeed, the apparatus has certain advantages for general valves, even where there is no requirement to seal around an internal line.

Various modifications and improvements may be made to the above-described embodiments within the scope of the invention herein intended.

We claim:

1. Apparatus for sealing a wellbore, the apparatus comprising a ram assembly having a pair of rams mounted in a housing, the rams rotatable about a common axis of rotation, wherein the apparatus has a first open position in which fluid may pass through the wellbore and a second closed position in which the rams abut to seal the wellbore, and wherein the apparatus is adapted to be moved between the open and closed positions by rotating the rams about their common axis of rotation, wherein the apparatus further comprises alignment means for guiding a wireline or pipe towards the centre of the wellbore during rotation of the rams, and wherein the alignment means is a drum adapted to rotate about an axis of rotation of the rams.

2. Apparatus as claimed in claim 1, wherein each ram is adapted to rotate about an axis perpendicular to a longitudinal axis of the wellbore.

3. Apparatus as claimed in claim 1, wherein the rams are adapted to be moved between the open and closed positions by rotating the rams in opposite senses.

4. Apparatus as claimed in claim 1, wherein the apparatus has a maximum lateral dimension of 80 cm.

5. Apparatus as claimed in claim 1, wherein a maximum lateral dimension is less than 50 cm.

6. Apparatus as claimed in claim 1, wherein a maximum lateral dimension is less than 40 cm.

7. Apparatus as claimed in claim 1, wherein the rams comprise locating formations for locating a wireline or pipe when in the closed position.

8. Apparatus as claimed in claim 1, wherein the drum is keyed with one of the rams and rotates with said ram.

9. Apparatus as claimed in claim 1, wherein the drum comprises a throughbore through which the wireline or pipe extends.

10. Apparatus as claimed in claim 9, wherein the throughbore defines an aperture extending in a longitudinal axis of the wellbore, arranged such that the aperture decreases in cross sectional area during rotation of the drum.

11. Apparatus as claimed in claim 9, wherein the throughbore is perpendicular to the axis of rotation of the drum.

12. Apparatus as claimed in claim 9, wherein a first opening of the throughbore is provided with a channel formed outwardly from an edge of the throughbore.

13. Apparatus as claimed in claim 12, wherein a second opening of the throughbore is provided with an edge formation diametrically opposed from the channel.

14. Apparatus as claimed in claim 13, wherein the edge formation is a second channel formed outwardly from an edge of the throughbore, such that the first and second channels together form an aperture extending through the drum perpendicular to the axis of rotation.

15. Apparatus as claimed in claim 14, wherein the aperture extends longitudinally in the wellbore and is central in the wellbore when the apparatus is in its closed position.

16. Apparatus as claimed in claim 13, wherein the edge formation is a cutting edge adapted to shear a wireline or pipe as the apparatus moves to its closed position.

17. Apparatus as claimed in claim 1, wherein each ram comprises a sealing assembly having one or more elastomeric seals.

18. Apparatus as claimed in claim 17, wherein each sealing assembly comprises an inner seal adapted to cooperate with an inner seal on the opposing ram to seal against the wireline or pipe.

19. Apparatus as claimed in claim 18, wherein the sealing assembly comprises an outer seal adapted to seal edges of the wellbore against well pressure.

20. Apparatus as claimed in claim 19, wherein the inner seal is retained on the ram by the outer seal.

21. Apparatus for sealing a wellbore around a wireline or pipe being run in the wellbore, the apparatus comprising:

a ram assembly having a pair of rams mounted for rotation about a common axis of rotation;

wherein the apparatus has a first osition in which the wellbore is open and a second position in which the wellbore is closed;

and wherein the actuating means is adapted to cause the rams of the ram assembly to rotate about their common axis of rotation from a position in which the apparatus is in its first open position, to a position in which the apparatus is in its second closed position in which the wellbore is sealed around the wireline or pipe, wherein the pair of rams are rotatably mounted in a housing of the apparatus, wherein the apparatus further comprises alignment means for guiding a wireline or pipe towards the centre of the wellbore during rotation of the rams, and wherein the alignment means is a drum adapted to rotate about the axis of rotation of a ram.

22. Apparatus as claimed in claim 21, wherein the ram comprise formations for locating a wireline or pipe in the closed position.

23. Apparatus for sealing a wellbore, the apparatus comprising a pair of rams which are rotatable about a common axis of rotation between a first position in which the wellbore is open and a second position in which the rams seal the wellbore around a wireline or pipe, characterized in that when the apparatus is in its operating orientation, the apparatus has a maximum lateral dimension which allows it to pass through an aperture in a rig platform through which the wellhead control equipment passes, wherein the rams are rotatably mounted in a housing of the apparatus, and wherein the alignment means is a drum adapted to rotate about the axis of the rams.

24. Apparatus as claimed in claim 23, wherein the maximum lateral dimension is less than 80 cm.

25. Apparatus as claimed in claim 23, wherein the maximum lateral dimension is less than 50 cm.

26. Apparatus as claimed in claim 23, wherein the maximum lateral dimension is less than 40 cm.

27. Apparatus as claimed in claim 23, wherein the rams comprise formations for locating a wireline or pipe in the closed position.

28. Apparatus as claimed in claim 23, wherein the apparatus further comprises alignment means for guiding a wireline or pipe towards the centre of the wellbore during rotation of the rams.

29. Apparatus for sealing a wellbore, the apparatus comprising a pair of rams which are rotatable about a common axis of rotation between a first position in which the wellbore is open and a second position in which the rams seal the wellbore around a wireline or pipe, characterised in that when the apparatus is in its operating orientation, the apparatus has a maximum lateral dimension of less than 80 cm, wherein the rams comprise formations for locating a wireline or pipe in the closed position, wherein the apparatus further comprises alignment means for guiding a wireline or pipe towards the center of the wellbore during rotation of the rams, and wherein the alignment means is a drum adapted to rotate about the axis of rotation of the rams.

30. Apparatus for sealing a wellbore, the apparatus comprising:

a ram assembly having a pair of rams, mounted for about a common axis of rotation; and actuating means;

the apparatus having a first open position in which fluid may pass through the wellbore and a second closed position in which the rams abut to seal the wellbore;

and wherein the rams are adapted to be moved from the first and second positions without substantially changing the volume of the actuating means exposed to well pressure, wherein the rams are rotatably mounted in the housing of the apparatus, wherein the apparatus further comprises alignment means for guiding a wireline or pipe towards the center of the wellbore during rotation of the rams, and wherein the alignment means is a drum adapted to rotate about the axis of rotation of the rams.

31. Apparatus as claimed in claim 30, wherein the rams comprise formations for locating a wireline or pipe in the closed position.

32. Apparatus for sealing a wellbore, the apparatus comprising:

a ram assembly having a pair of rams rotatably mounted in a housing, apparatus having a first open position in which fluid may pass through the wellbore and a second closed position in which the ram abut to seal the wellbore, wherein the apparatus is adapted to be moved between the open and closed position by rotating the rams; and a drum adapted to rotate about an axis of rotation of the rams, for the guiding a wireline or pipe towards the center of the wellbore during rotation of the rams.

33. Apparatus for sealing a wellbore, the apparatus comprising:

a ram assembly having a pair of rams rotatably mounted in the housing;

actuating means; and a drum adapted to rotate about an axis of rotation of the rams;

wherein the apparatus has a first open position in which fluid may pass through the wellbore and a second closed position in which the rams abut to seal the wellbore;

and wherein the rams are adapted to be moved between the first and second positions by rotating the rams without substantially changing the volume of the drum exposed to well pressure;

and further wherein the drum is for guiding a wireline or pipe towards the centre of the wellbore during rotation of the rams.

* * * * *

UNITED STATES PATENT AND TRADEMARK OFFICE

CERTIFICATE OF CORRECTION

PATENT NO. : 7,510,002 B2
APPLICATION NO. : 11/070114
DATED : March 31, 2009
INVENTOR(S) : Gareth Edward George Brown et al.

It is certified that error appears in the above-identified patent and that said Letters Patent is hereby corrected as shown below:

Column 12, line 42, change “rotation;” to -- rotation; and actuating means --;

Column 12, line 43, change “osition” to -- position --;

Column 12, line 58, change “ram” to -- rams --;

Column 13, line 4, change “axis of” to -- axis of rotation of --;

Column 13, line 34, change “rams, mounted for about” to -- rams mounted for rotation about --;

Column 13, lines 40-41, change “the first and second positions” to -- between a position in which the apparatus is in the first position and a position in which the apparatus is in the second position --;

Column 14, line 2, change “the housing” to -- a housing --;

Column 14, line 14, change “housing, apparatus” to -- housing, the apparatus --;

Column 14, line 16, change “ram” to -- rams --;

Column 14, line 18, change “position” to -- positions --;

Column 14, line 20, change “for the guiding” to -- for guiding --;

UNITED STATES PATENT AND TRADEMARK OFFICE

CERTIFICATE OF CORRECTION

PATENT NO. : 7,510,002 B2
APPLICATION NO. : 11/070114
DATED : March 31, 2009
INVENTOR(S) : Gareth Edward George Brown et al.

It is certified that error appears in the above-identified patent and that said Letters Patent is hereby corrected as shown below:

Column 14, line 26, change “the housing;” to -- a housing; --.

Signed and Sealed this

Fourteenth Day of July, 2009

JOHN DOLL
*Acting Director of the United States Patent and Trademark Office*